US007685986B2

(12) United States Patent
Agapiades et al.

(10) Patent No.: US 7,685,986 B2
(45) Date of Patent: Mar. 30, 2010

(54) DISC VALVE SYSTEM FOR AN INTERNAL COMBUSTION ENGINE

(75) Inventors: Fotios Agapiades, Ano Glyfada (GR); Thomas Agapiades, 744 Bridge St., Yuba City, CA (US) 94991

(73) Assignee: Thomas Agapiades, Yuba City, CA (US)

( * ) Notice: Subject to any disclaimer, the term of this patent is extended or adjusted under 35 U.S.C. 154(b) by 359 days.

(21) Appl. No.: 10/590,065

(22) PCT Filed: Feb. 18, 2005

(86) PCT No.: PCT/CA2005/000209

§ 371 (c)(1),
(2), (4) Date: Jun. 19, 2007

(87) PCT Pub. No.: WO2005/080759

PCT Pub. Date: Sep. 1, 2005

(65) Prior Publication Data

US 2008/0041325 A1 Feb. 21, 2008

Related U.S. Application Data

(63) Continuation of application No. 10/783,137, filed on Feb. 19, 2004, now Pat. No. 6,976,465, which is a continuation of application No. 10/783,110, filed on Feb. 19, 2004, now abandoned.

(51) Int. Cl.
*F01L 7/00* (2006.01)

(52) U.S. Cl. ..... 123/190.14; 123/190.17; 123/80 BB; 123/80 D

(58) Field of Classification Search ..... 123/190.14, 123/190.17, 190.4, 80 R, 80 BB, 80 D
See application file for complete search history.

(56) References Cited

U.S. PATENT DOCUMENTS

| | | | |
|---|---|---|---|
| 1,034,877 | A | 8/1912 | Coffin et al. |
| 1,098,679 | A | 6/1914 | Mueller et al. |
| 1,227,698 | A | 5/1917 | Tibbetts |
| 1,726,299 | A | 8/1929 | Heurich et al. |
| 5,076,219 | A | 12/1991 | Pellerin |
| 5,988,133 | A | 11/1999 | Agapiades et al. |

FOREIGN PATENT DOCUMENTS

| | | |
|---|---|---|
| CA | 2303736 | 2/2005 |

*Primary Examiner*—Noah Kamen
(74) *Attorney, Agent, or Firm*—Ladas & Parry LLP

(57) ABSTRACT

A disc valve system for a piston driven internal combustion engine. The disc valve system comprises at least one rotating disc valve and an intermediate seal member. The disc is mounted between a cylinder head manifold having exhaust and intake ports and an engine cylinder housing the piston and defining a combustion chamber. The disc comprising sequencing ports to be brought into periodic communication with the exhaust and intake ports at cyclic intervals of the rotating movement thereof, thereby providing for the exhaust and intake ports to be brought into periodic communication with the combustion chamber. The intermediate seal member is mounting between the disc and the cylinder so as to seal the combustion chamber at a junction of the disc and the cylinder. The intermediate seal member comprising a dynamic seal for contact with the disc and a stationary seal for sealing contact with the engine cylinder. The rotating movement of the disc sequentially opens and closes each exhaust and intake ports synergistically with the translational movement of the piston. Engines comprising these disc valve systems are also disclosed herein.

102 Claims, 20 Drawing Sheets

DISC VALVE SYSTEM FOR AN INTERNAL COMBUSTION ENGINE

This is a continuation of Ser. No. 10/783,137, filed Feb. 19, 2004, now U.S. Pat. No. 6,976,465, which is a continuation of Ser. No. 10/783,110, filed Feb. 19, 2004, now abandoned.

FIELD OF THE INVENTION

The present invention relates to disc valve system. More specifically, the present invention is concerned with disc valve system for a piston driven internal combustion engine as well as an engine comprising such a disc valve system.

BACKGROUND OF THE INVENTION

U.S. Pat. No. 5,988,133 issued to Agapiades et al. on Nov. 23, 1999 teaches a rotating disc valve that opens an closes exhaust and intake ports of a cylinder head in order to provide communication with the combustion chamber. This disc is rotatively mounted within the cylinder head of an internal combustion engine having beveled gear teeth at its outer perimeter and a plurality of equally-spaced ports about its center of rotation which will meet with a light number of sets of exhaust and intake conduits within the cylinder head for cyclic indexing therewith. These exhaust and intake conduits lead from the combustion chamber to a respective exhaust and intake manifold. The disc valve rotates synergistically with the crankshaft via a chain mounted to a sprocket on the crankshaft as well as to a second sprocket which is in operative communication with a pinion gear having bevel teeth meshed with the bevel teeth of the disc 12.

Therefore, the disc valve allows for intake and exhaust through the piston exhaust in and from a combustion chamber formed by the engine cylinder which contains a piston.

A drawback of the prior art design is that combustion within the cylinder combustion chamber is not sealed. Other drawbacks of the prior art include, and without limitation: the positioning of an igniter such as sparkplugs on the disc valve itself, hence causing the sparkplug to turn therewith; the lack of lubrication between the disc valve and the cylinder head; the inflexibility of the timing gear (top sprocket mounted to the pinion which acts on the disc valve); the fact that the ports of the rotating disc valve cannot be modified in size during operation; the fact that the ports are symmetrical to one another and hence act in codependence, which limits the configuration of the cylinder head as well as the overall operation of intake and exhaust; the fact that the chain mounted on the sprockets moves in a constant and uniform way which does not allow retarded intake and exhaust port openings; the fact that the disc valve is directly mounted within the cylinder head.

There thus remains a need for an improved disc valve system and an engine comprising same.

OBJECTS OF THE INVENTION

An object of the present invention is to provide an improved disc valve system and engine comprising same.

SUMMARY OF THE INVENTION

More specifically, in accordance with the present invention, there is provided a disc valve system for a piston driven internal combustion engine, said disc valve system comprising:

at least one rotating disc for mounting between a cylinder head manifold comprising exhaust and intake ports and an engine cylinder housing the piston and defining a combustion chamber, said rotating disc comprising sequencing ports so configured as to be brought into periodic communication with said exhaust and intake ports at cyclic intervals of the rotating movement of said rotating disc thereby providing for said exhaust and intake ports to be brought into periodic communication with said combustion chamber; and an intermediate seal member for mounting between said rotating disc and the engine cylinder so as to seal the combustion chamber at a junction of said rotating disc and the engine cylinder, said intermediate seal member comprising a dynamic seal for contact with said rotating disc and a stationary seal for sealing contact with the engine cylinder;

whereby the rotating movement of said rotating disc sequentially opens and closes each said exhaust and intake ports synergistically with the translational movement of the piston In accordance with another aspect of the present invention there is provided a piston driven internal combustion engine comprising:

at least one cylinder head manifold comprising exhaust and intake ports;

at least one engine cylinder housing a piston and defining a combustion chamber, at least one rotating disc mounted between said cylinder head manifold and said engine cylinder, said rotating disc comprising sequencing ports so configured as to be brought into periodic communication with said exhaust and intake ports at cyclic intervals of the rotating movement of said rotating disc thereby providing for said exhaust and intake ports to be brought into periodic communication with said combustion chamber; and an intermediate seal member mounted between said rotating disc and said engine cylinder so as to seal said combustion chamber at a junction of said rotating disc and said engine cylinder, said intermediate seal member comprising a dynamic seal for contact with said rotating disc and a stationary seal for sealing contact with said engine cylinder;

whereby the rotating movement of said rotating disc sequentially opens and closes each said exhaust and intake ports synergistically with the translational movement of said piston.

In accordance with a further aspect of the present invention, there is provided a rotatable disc valve for mounting between a cylinder head manifold having exhaust and intake ports and an engine cylinder housing a piston and defining a combustion chamber of piston driven internal combustion engine, said disc comprising:

an outer face facing the cylinder head manifold when said disc valve is mounted thereto;

an inner face facing the engine cylinder when said disc valve is mounted thereto, said inner face comprising a turbulator; and sequencing ports so configured as to be brought into periodic communication with said exhaust and intake ports at cyclic intervals of the rotating movement of said disc thereby providing for said exhaust and intake ports to be brought into periodic communication with said combustion chamber;

whereby said turbulator portion is configured to provide for turbulence thereunder during the rotating movement of said disc.

In accordance with yet another aspect of the present invention, there is provided a rotatable disc valve for mounting between a cylinder head manifold having exhaust and intake ports and an engine cylinder housing a piston and defining a combustion chamber of piston driven internal combustion engine, said disc comprising:

sequencing port apertures so configured as to be brought into periodic communication with said exhaust and intake ports at cyclic intervals of the rotating movement of said disc thereby providing for said exhaust and intake ports to be brought into periodic communication with said combustion chamber, said sequencing port apertures comprising respective shutter members biased towards a first positioned which at least keeps a respective port aperture partially closed;

whereby said shutter members are moveable towards a position that progressively opens said port apertures during the rotating movement of said disc valve.

In accordance with yet a further aspect of the present invention there is provided a rotatable disc valve for mounting between a cylinder head manifold having exhaust and intake ports and an engine cylinder housing a piston and defining a combustion chamber of piston driven internal combustion engine, said disc comprising:

a plurality of intake and exhaust sequencing ports of differing dimensions being disposed in respective intake and exhaust series, said intake and exhaust sequencing port apertures being so configured as to be respectively brought into periodic communication with said exhaust and intake ports at cyclic intervals of the rotating movement of said disc thereby providing for said exhaust and intake ports to be brought into periodic communication with said combustion chamber.

In accordance with still another aspect of the present invention there is provided a rotatable disc valve for mounting between a cylinder head manifold having exhaust and intake ports and an engine cylinder housing a piston and defining a combustion chamber of piston driven internal combustion engine, said disc comprising:

an outer face facing the cylinder head manifold when said disc valve is mounted thereto;

sequencing port apertures so configured as to be brought into periodic communication with said exhaust and intake ports at cyclic intervals of the rotating movement of said disc thereby providing for said exhaust and intake ports to be brought into periodic communication with said combustion chamber, said outer face comprising a generally circular protrusion closer to the periphery of said disc valve than to said centre thereof for mating with a complementary indentation formed in the cylinder head manifold.

In accordance with still a further aspect of the present invention, there is provided an intermediate seal member for mounting between an engine cylinder housing a piston and defining a combustion chamber, and a rotating disc valve in contact with a cylinder head manifold of a piston driven engine, said intermediate seal member comprising:

a dynamic seal for contact with the rotating disc valve; and a stationary seal for sealing contact with the engine cylinder, whereby said intermediate seal member seals the combustion chamber at a junction of the rotating disc valve and the engine cylinder.

In accordance with still yet another aspect of the present invention, there is provided a timing gear for a disc valve engine, said timing gear having a hub aligned concentrically about its axis of rotation, said hub holding a resilient member, said timing gear rotatively mounted on a timing shaft, said timing shaft comprising a bevel gear fixedly attached at one end and a plurality of lateral members fixedly attached at the opposite end, said lateral members passing through the center of said resilient member and in contact with a plurality of recessed niches in said resilient member.

It should be noted that the terms "disc", "rotating disc" or "disc valve" can be used interchangeably throughout the disclosure and the claims.

It should also be noted that the terms "first" and "second"; "outer" and "inner" are used herein as indicative terms only.

Other objects, advantages and features of the present invention will become more apparent upon reading of the following non restrictive description of embodiments thereof, given by way of example only with reference to the accompanying drawings.

BRIEF DESCRIPTION OF THE DRAWINGS

In the appended drawings where like elements are referenced by like reference numerals and in which:

FIG. 22 is a perspective view of an intermediate seal member and the top of a piston cylinder in accordance with another embodiment of the invention;

DESCRIPTION OF EMBODIMENTS

It should be noted that the general functioning of a disc valve system is disclosed in U.S. Pat. No. 5,988,133, which is incorporated herein by reference. The present application is based on the following priority documents: U.S. Provisional patent application Ser. No. 10/783,137 filed on Feb. 19, 2004 and titled "Disc Valve Intermediate Ring Seal" and U.S. Provisional patent application Ser. No. 10/783,110 filed on Feb. 19, 2004 and titled "Timing Gear Flexible Coupling" which are incorporated herein by reference. The present application also requests priority on the U.S. Provisional patent application filed on 18 Jan. 2005 and titled "Disc Valve System", which is incorporated herein by reference.

With reference to the appended drawings, embodiments of the invention will be herein described so as to exemplify the invention and not limit its scope.

Figure 1:
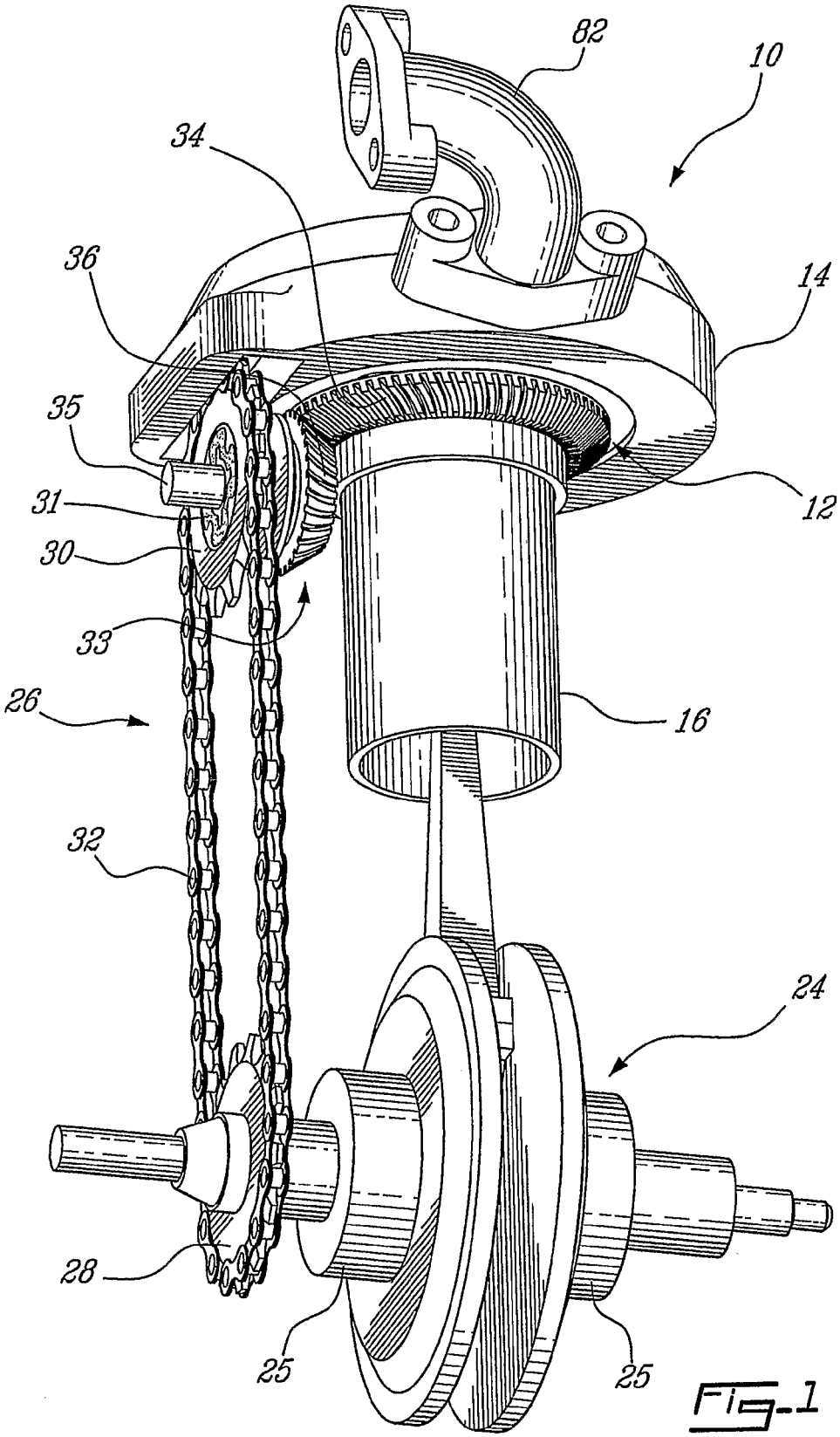
FIG. 1 is a perspective view of the disc valve system in accordance with an embodiment of the invention.

FIG. 1 shows the disc valve system 10 in accordance with an embodiment of the invention.

Figure 6:
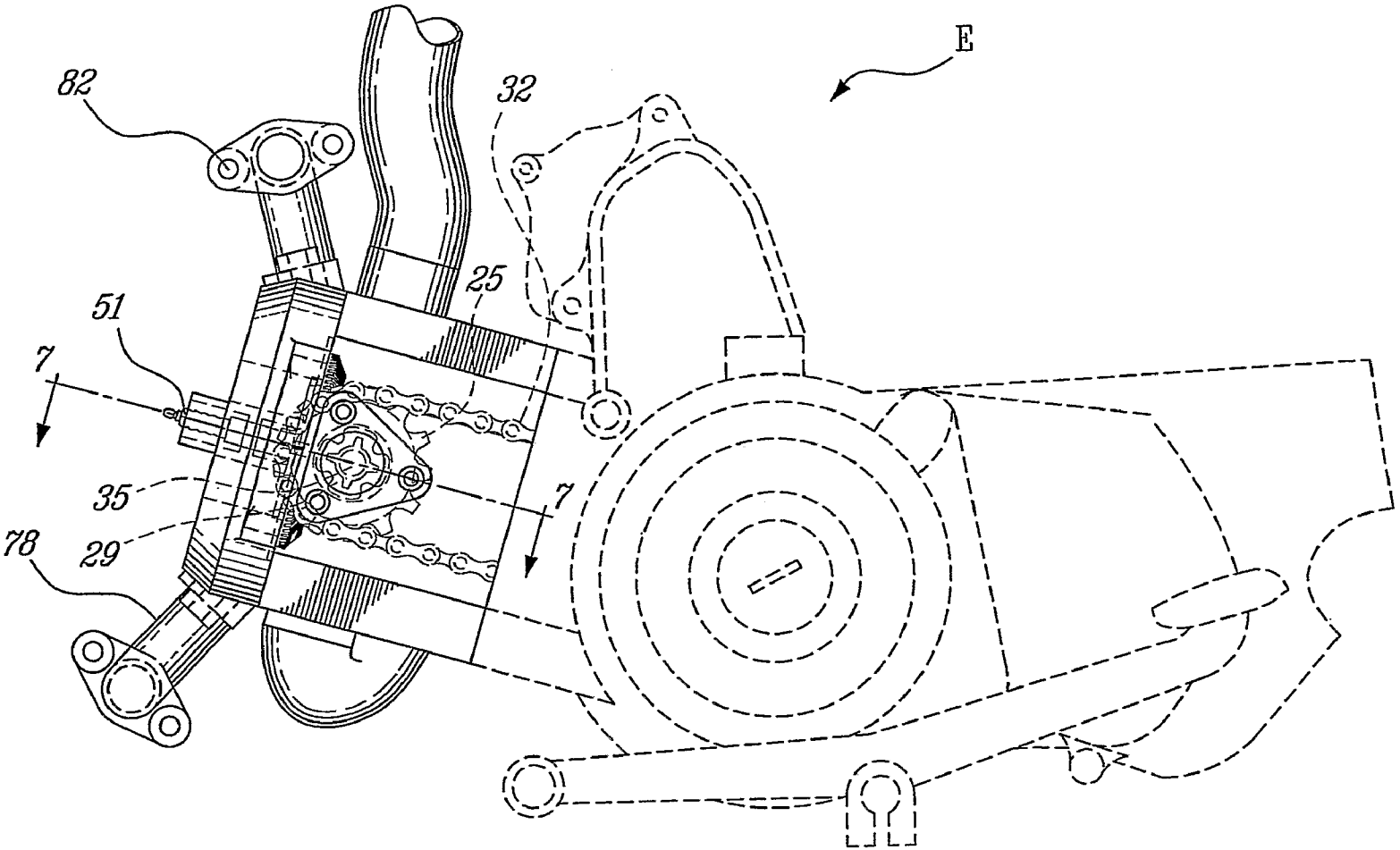
FIG. 6 is a lateral view of the disc valve system mounted onto an engine in accordance with an embodiment of the invention.

Disc valve system 10 is to be mounted on an engine E (as shown in FIG. 6). The present invention also provides an engine E including the disc valve system such as 10 of the present invention.

The disc valve systems of the present invention can be mounted to a variety of piston-driven engines. The engines of the invention, can be for any type of transport vehicle such as an automobile or a motorcycle for example; these can be used for equipment such as gardening equipment and the like; these engines can be two stroke or four-stroke piston engines. Hence, the disc valve systems of the present invention can be used for engines having a variety of sizes and power capabilities. These engines can be fuel engines of any kind such as gasoline or diesel engines or any other type of fossil fuel as understood by the skilled artisan. The engines of the invention can be fuel cell engines powered by methanol, ethanol, natural gas, gasoline, compressed hydrogen to give but only a few non-limiting examples. Of course, the engines of the invention can be electrically powered as is understood by the skilled artisan.

As shown in FIGS. 1, 2, 3, and 5, the disc valve system 10 includes a rotating disc 12, which acts as a valve. This disc 12 is mounted between a cylinder head manifold 14 and an engine cylinder 16, which, defines a combustion chamber 18 (see FIGS. 2, 7, 8, 19, 22 and 23) that contains a piston 20, which includes piston head 21. A connecting rod 22 is mounted to the piston head 21, and descends from the engine cylinder 16. The combustion chamber 18 provides a working space for the piston 20 for translational movement thereof as shown by arrow T in FIGS. 2, 3, 4, 5, 7, 8, and 19.

As will be detailed herein, the rotating disc 12 rotates synergistically with the translational movement T of the piston 20 or piston head 21.

As will be exemplified herein, the disc 12 is in operative communication with a disc-rotator so as to cause this disc 12 to rotate in accordance with the present invention.

In the example shown here, the piston connecting rod 22 is mounted to a crankshaft 24.

In an embodiment, the disc rotator of the present invention is a transmission assembly configured to be put in operative communication with the crankshaft 24 and with rotating disc 12 such that the disc 12 rotates in relation to the revolution of the crankshaft 24.

FIGS. 1, 2, 3, and 5, for example, show a transmission assembly 26 in accordance with one non-limiting embodiment of the invention. In this embodiment, the transmission assembly 26 is a gear assembly comprising first and second gears 28 and 30 (see FIG. 1), which are in the form of sprockets. Sprockets 28 and 30 are in operative communication via a movement-transfer assembly in the form of a chain member 32. Of course, movement-transfer assembly 32 may be provided in the form of a wire, a belt and the like. The first sprocket gear 28 is in operative communication with the crankshaft 24 while the second sprocket gear 30 is in operative communication with the disc 12.

In this embodiment, the second sprocket gear 30 is communication with the disc 12 via a disc-gear 33, which is in operative communication with disc gear elements 34 on the disc 12. In this example, the disc gear elements are bevel teeth and the disc-gear 33 is a pinion gear having bevel teeth 36 meshed with the disc gear teeth 34.

In this way, the first sprocket gear 28, which is fixedly mounted to the crankshaft 24, is caused to rotate in bearings 25 (see FIG. 1) by the engine piston 20 acting through the connecting rod 22 in the general matter of a four-bar slider mechanism. The rotation of the first sprocket gear 28 is transmitted to the second sprocket gear 30 via the chain 32 mounted to both the first and second sprocket gears 28 and 30. The second sprocket gear 30 includes an aperture 31 for receiving an extending member such as a rod or shaft 35, which extends from bevel pinion gear 33.

Figure 2:
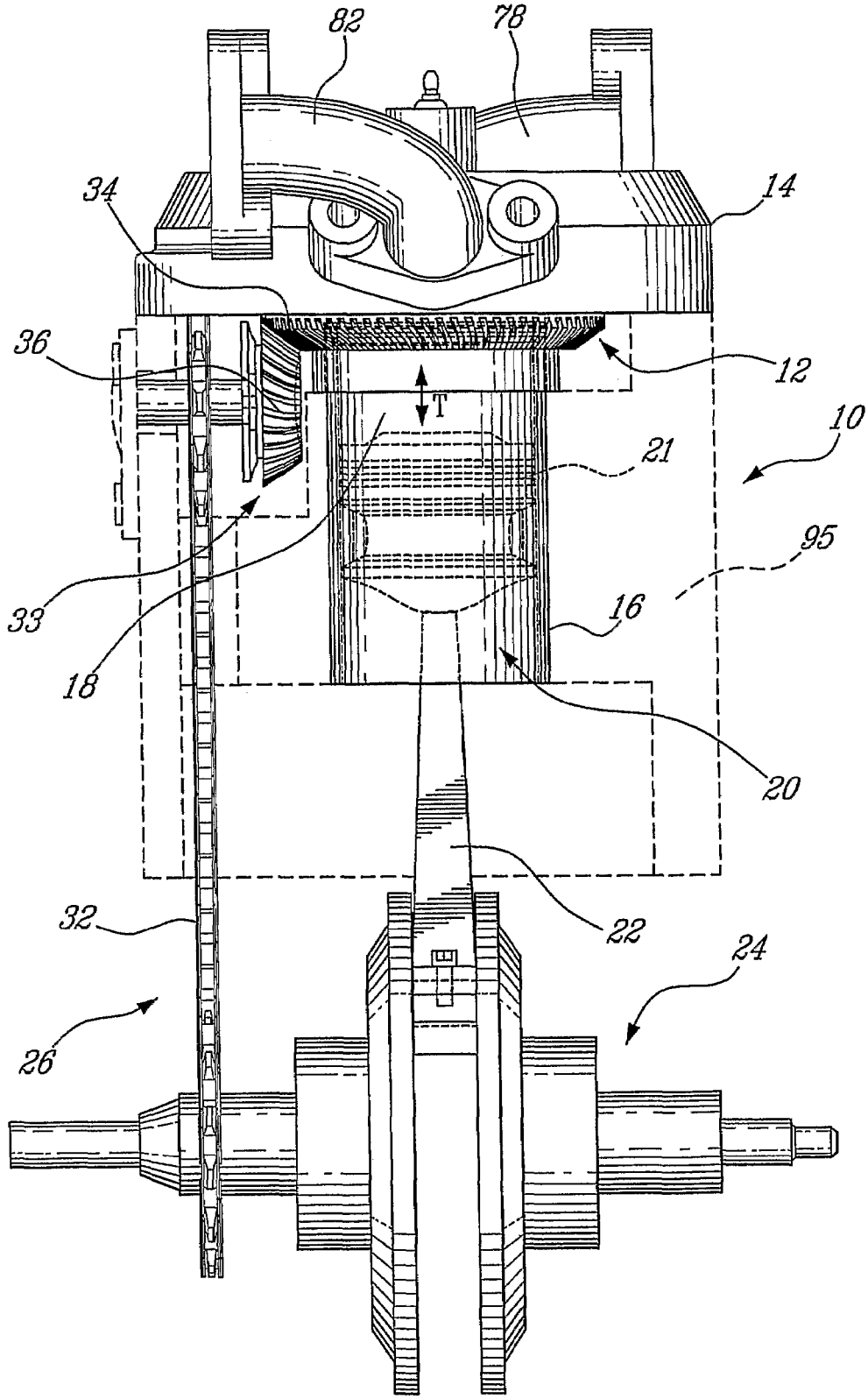
FIG. 2 is a front elevational view of the disc valve system of FIG. 1 showing the cylinder box and cylinder in dotted line.

FIG. 2 also shows the cylinder box 95 in dotted form.

Figure 3:
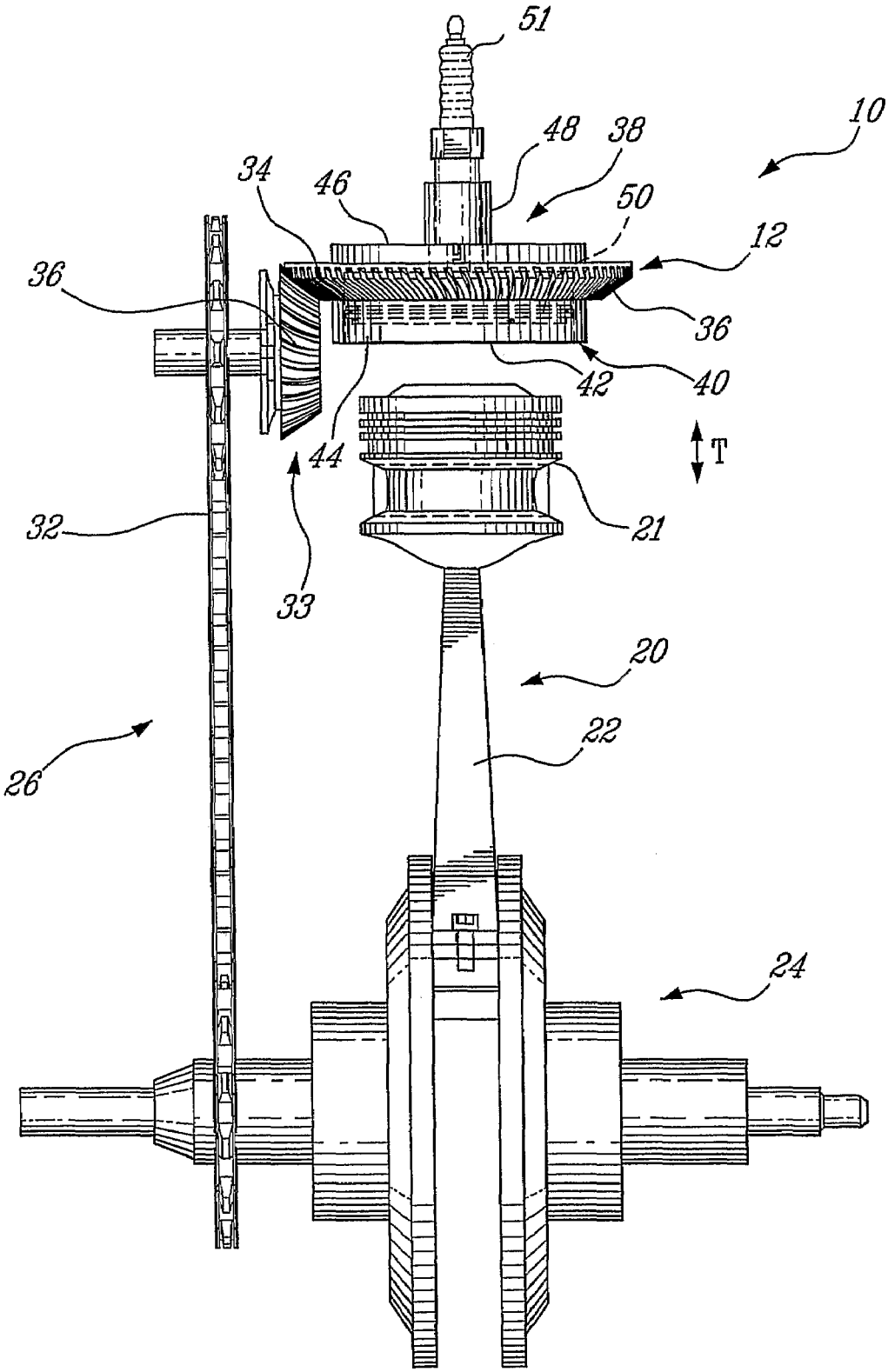
FIG. 3 is a front elevational view of the disc valve system of FIG. 2 without cylinder box and cylinder.

FIG. 3 is similar to FIG. 1 except that the cylinder head manifold 14 and engine cylinder 16 have been removed. The disc 12 comprises a top or outer face 38 and a bottom or inner face 40. In this embodiment, the inner face 40 comprises the bevel teeth 36 near the periphery thereof and a sealing portion 42 including a skirt 44.

Figure 7:
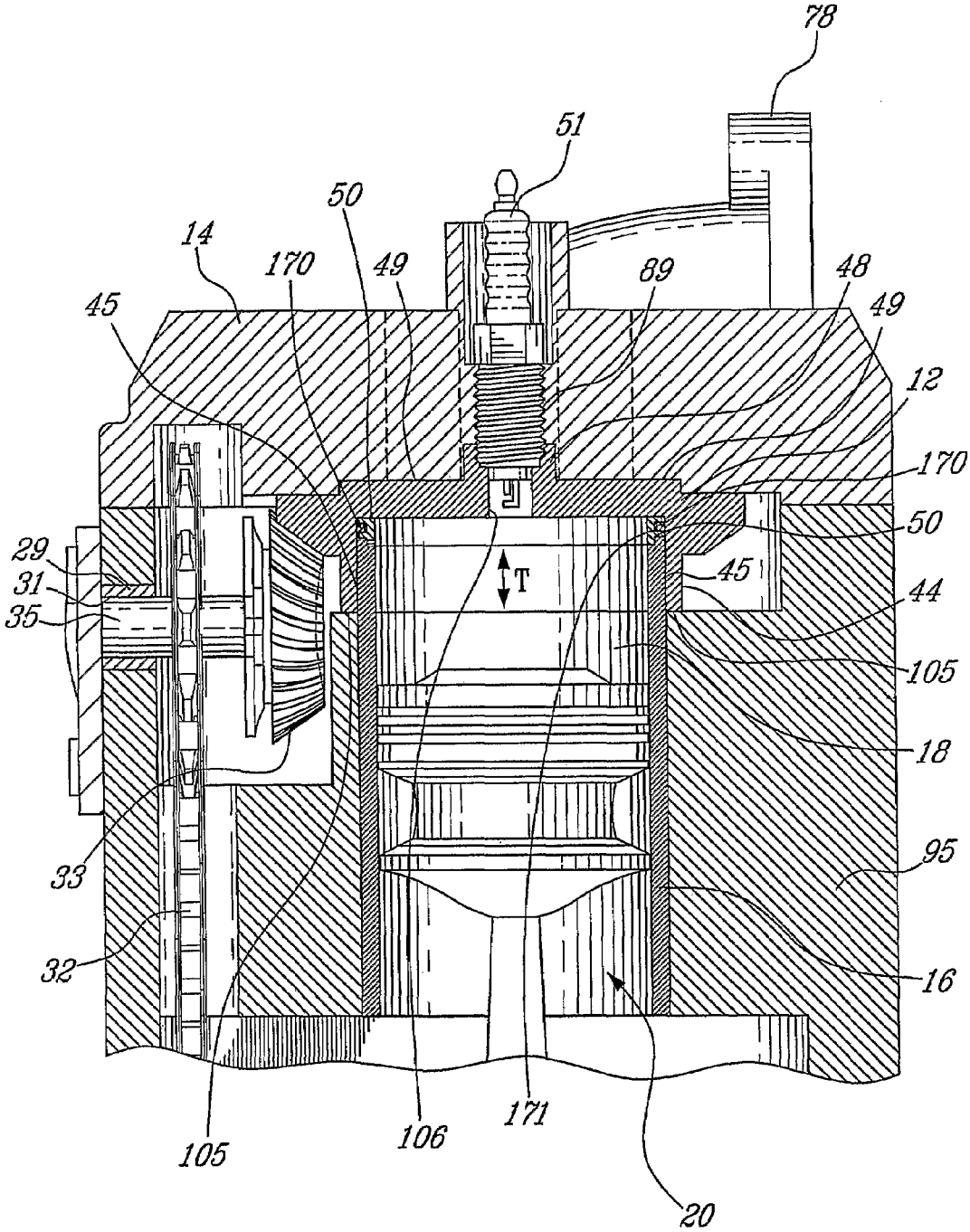
FIG. 7 is a is a sectional view taken along line 7-7 of FIG. 6.

With reference to FIG. 7, skirt 44 covers the top mates with and covers portion of the engine cylinder 16. Flexible seals 45 are positioned between the disc 12 and the engine cylinder 16.

Turning back to FIG. 3, the outer face 38 comprises a top sealing surface 46 as well as a central tubular shaft 48.

As shown in FIG. 7, the shaft 48 is rotatably mounted in the cylinder head manifold 14 and the top sealing surfaces 46 are in slidable contact with this cylinder head manifold 14. Flexible seals 49 are placed between the disc 12 and the cylinder head 14.

Turning back to FIG. 3 and with reference to FIG. 7, an ignitor such as a spark plug 51 (which can be replaced by a fuel injector) is mounted to the tubular shaft 48.

Figure 5:
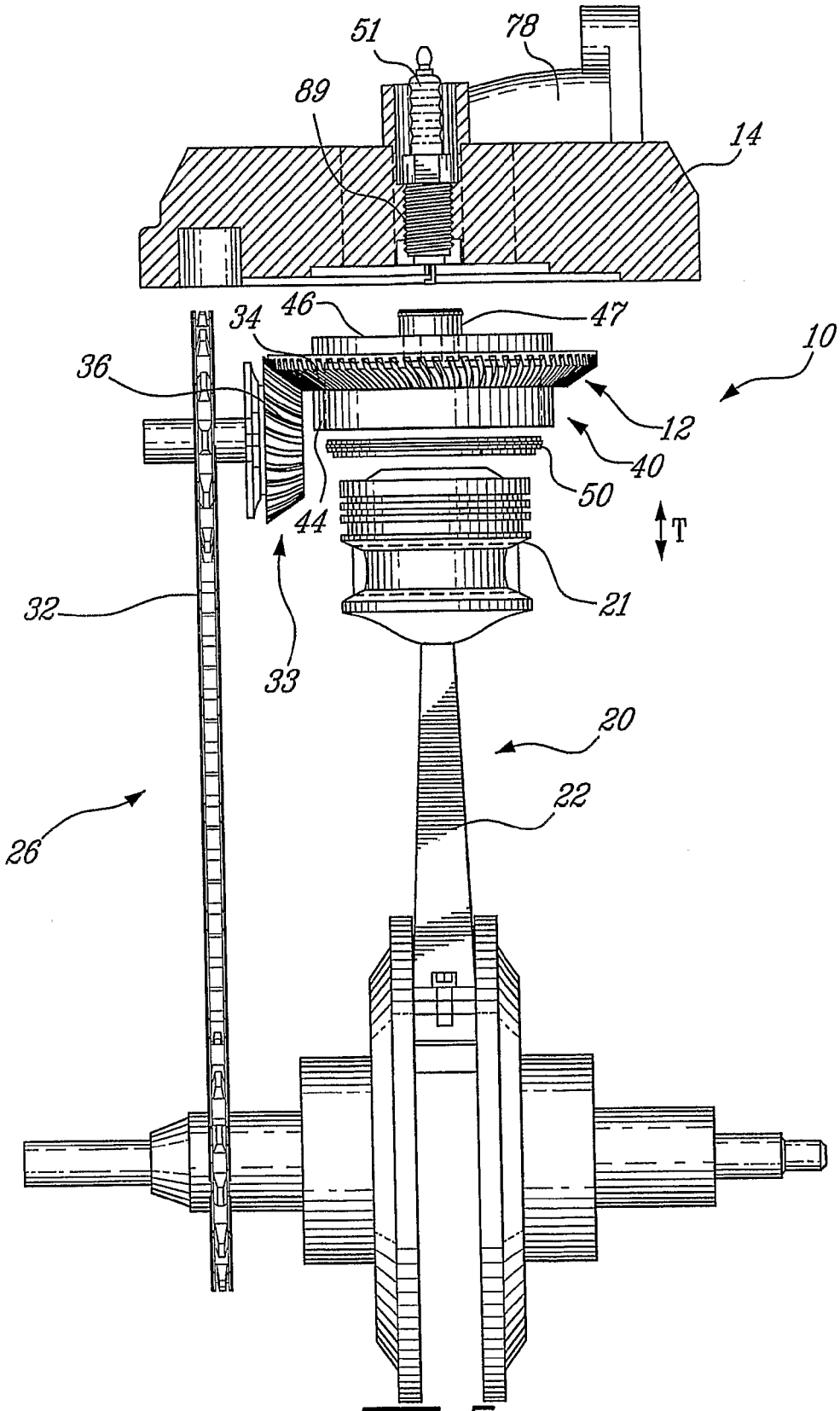
FIG. 5 is a front elevational view of the disc valve system in accordance with a further embodiment of the invention.

In the embodiment, shown in FIG. 5, the disc 12 has a short tubular shaft 47 and the spark plug 51 (which can be replaced by a fuel injector) is mounted directly to the cylinder head manifold 14 which defines a receiving aperture 89.

With reference to FIGS. 3, 5, 7, 8, 19, 22 and 23, an intermediate seal member 50 (or 50A) is positioned between the disc 12 and the engine cylinder 16, for sealing the combustion chamber 18 at a junction of the disc 12 and the engine cylinder 16.

Figure 4:
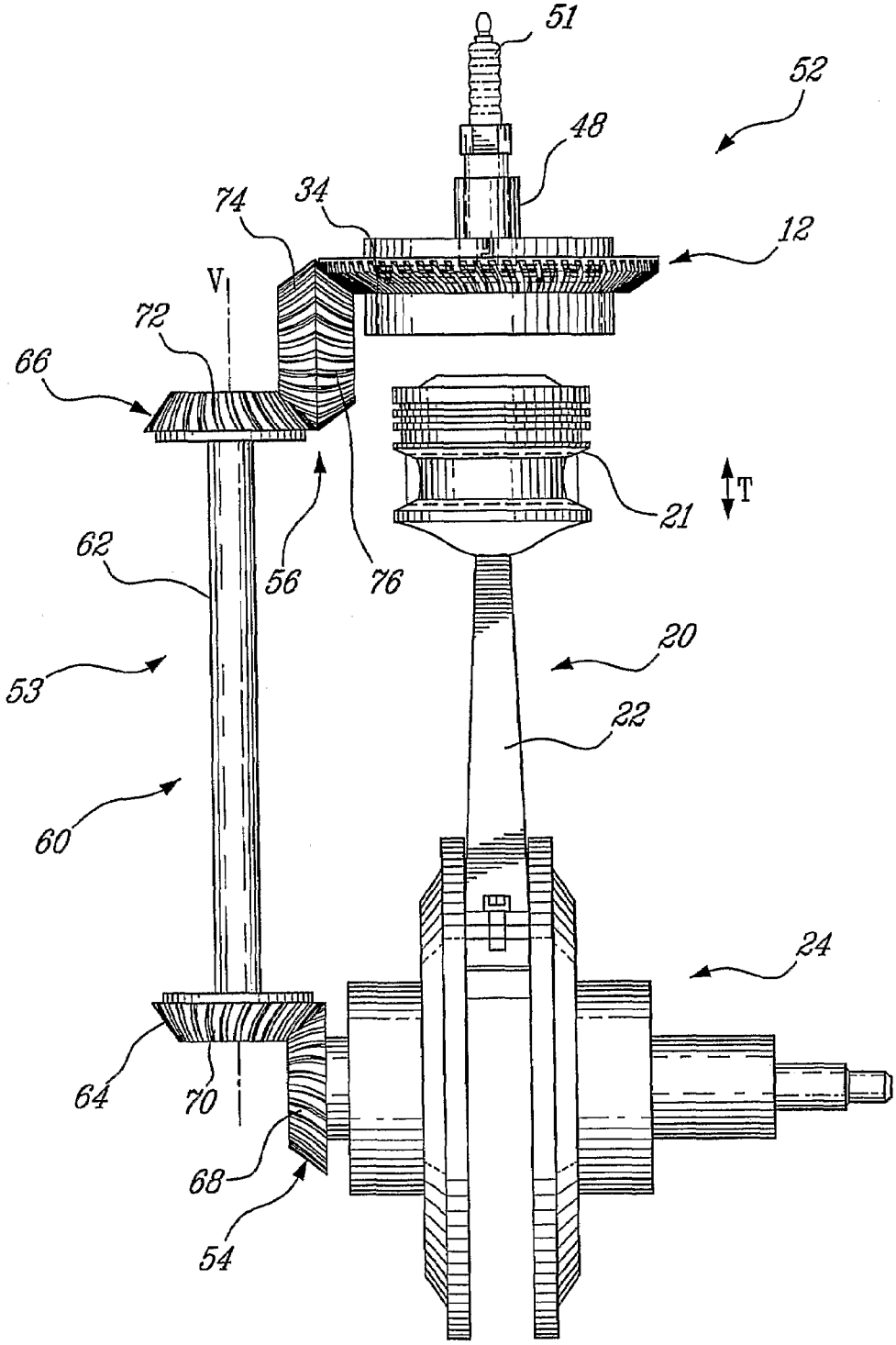
FIG. 4 is a front elevational view of the disc valve system in accordance with another embodiment of the invention.

FIG. 4 shows the disc valve system 52, in accordance with another embodiment thereof. Only the features, which are different from disc valve system 10 will be described herein for concision purposes only. In the disc valve system 52, the disc-rotator is a transmission assembly 53 in operative communication with the crankshaft 24 and the disc 12. Again this transmission assembly 53 is a gear assembly. The engine valve train components of gear assembly 53 for transferring the movement of the crankshaft 24 to the disc 12 includes first and second gears in the form of pinion gears 54 and 56 that are in operative commutation via a movement transfer assembly 60. The first pinion gear 54 is in fixedly mounted to the crankshaft 24. The second pinion gear 56 is in operative communication with the disc 12. The movement transfer assembly 60 includes an elongate member 62 being rotatable about its longitudinal axis Y. This elongate member 62 includes first and second elongate-member gears 64 and 66 respectively at the longitudinal ends thereof. Pinion gear 54 includes bevel teeth 68, which are meshed with the bevel teeth 70 of pinion gear 64. Pinion gear 66 includes bevel teeth 72, which are meshed with bevel teeth 74 of disc gear 56. Disc gear 56 is a double pinion gear and includes a second opposite face with bevel teeth 76, which acts as a disc-gear. Bevel teeth 76 are meshed with the bevel teeth 34 of the disc 12.

In this case, gears 54 and 68 are the first and second gears, and the rotating rod 62 is the movement transmission assembly.

In this way, the movement of crankshaft 24 is transferred to disc 12 via rod 62 being acted upon by pinion gear 54, which acts on double pinion disc-gear 56, which in turn acts on disc 12.

Of course a variety of methods can be contemplated for transferring the movement of the crankshaft 24 to the disc 12 can be contemplated by the ordinarily skilled artisan such as using a plurality of operatively communicating gears to give but one example. Of course it should be noted that the disc 12 is to move synergistically with the piston 12 since the rotating movement of the disc provides intake and exhaust and the translational movement T of the piston 20 provides compression. Timing the movements of the disc 12 and the piston 20 can be provided in a variety of ways known to the skilled artisan within the context of the present invention.

Figure 8:
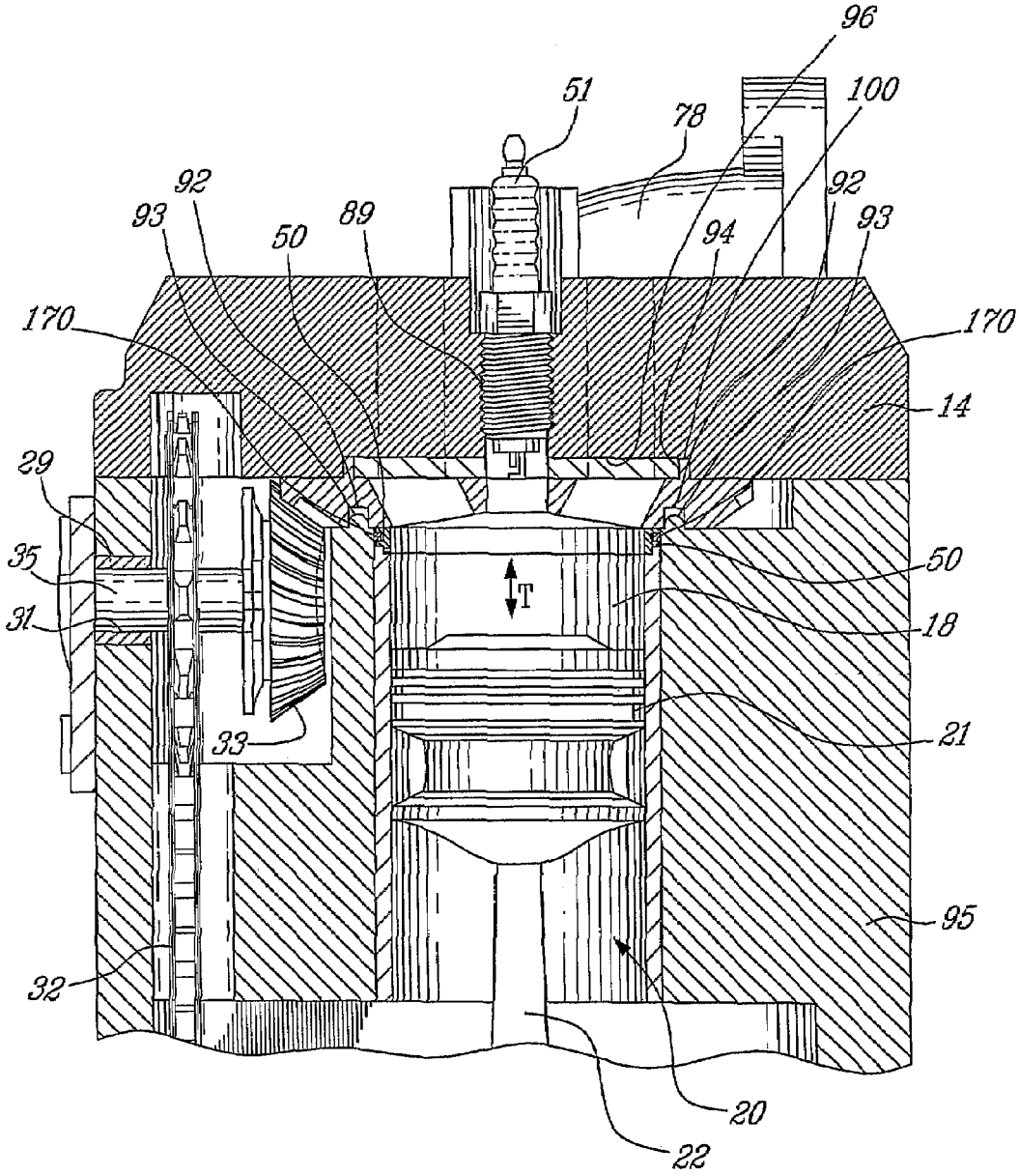
FIG. 8 is a sectional view similar to FIG. 7 in accordance with another embodiment of the invention.
Figure 9:
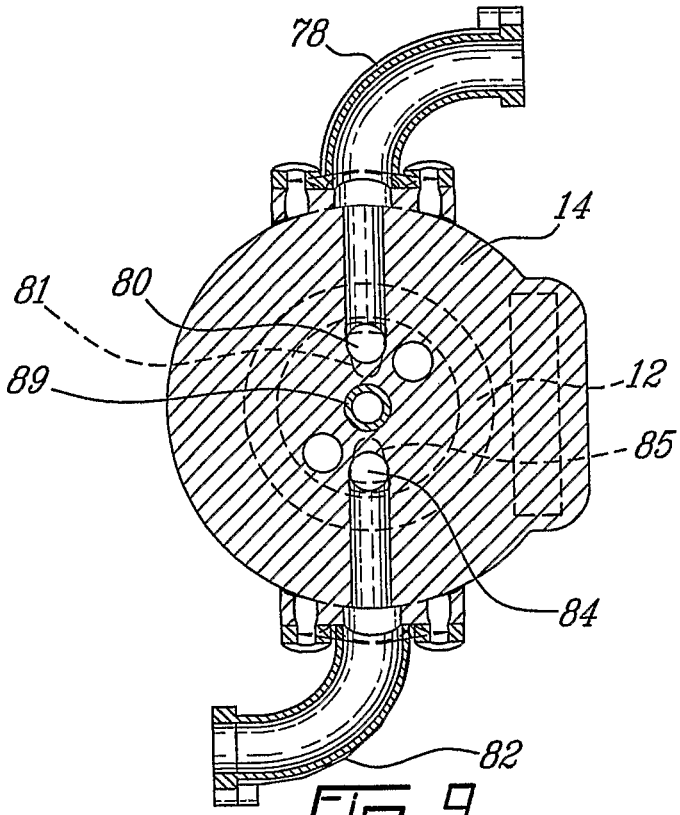
FIGS. 9 and 10 are top sectional views of the cylinder head manifold.
Figure 10:
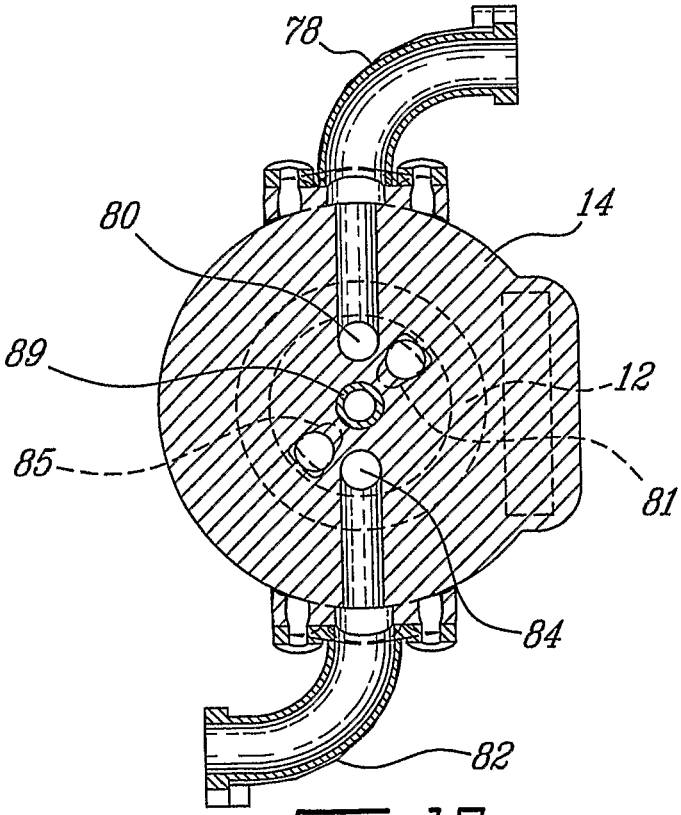

FIGS. 1, 2, 5, 6, 7, 8, 9 and 10 show the cylinder head manifold 14 including an intake conduit 78 leading to an intake port 80 and an exhaust conduit 82 leading to an exhaust port 84. As shown in FIGS. 9 and 10, the rotating disc valve 12 includes an intake sequencing port 81 as well as an exhaust sequencing port 85 which are configured as to be brought into periodic communication with said exhaust and intake ports 80 and 84 respectively, so as to open these ports as shown in FIG. 9 or close these ports as shown in FIG. 10 at cyclic intervals of the rotating movement of rotating disc 12. thereby providing for the intake and exhaust ports 80 and 84 to be brought into periodic communication with the combustion chamber 18.

Of course a greater number of intake and exhaust ports 80 and 84 can be provided. These ports 80 and 84 can be positioned in variety of fashions and be provided in a variety of configurations, shapes and sizes to match corresponding ports of a variety of disc valves in accordance with the present invention.

FIGS. 11, 12, 13, 14, 15, 16, 17, 18, 19 and 20 illustrate a variety of other non-limiting embodiments of the rotating disc valves, in accordance with the present invention.

Figure 11:
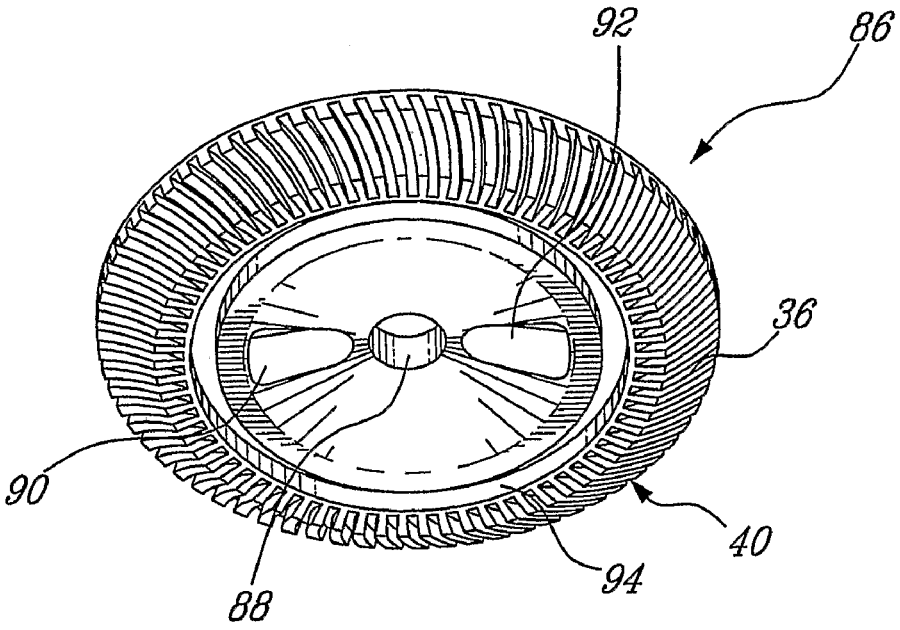
FIG. 11 is a bottom perspective view of a rotating disc valve in accordance with an embodiment of the invention.

FIG. 11 shows a rotating disc 86 in accordance with a non-limiting embodiment of the invention, having an inner face 40. This inner face 40 includes bevel teeth 36, a generally central aperture 88, and sequencing ports 90 and 92, which can respectively be either intake or exhaust sequencing ports. The generally central aperture 88 is aligned with a cylinder head aperture 89 as shown in FIGS. 7, 8, 9 and 10. The disc 86 also includes a generally circular indentation or groove 94 that is mated with a complementary protrusion 93 of the cylinder box 95 as shown in FIG. 8.

Figure 12:
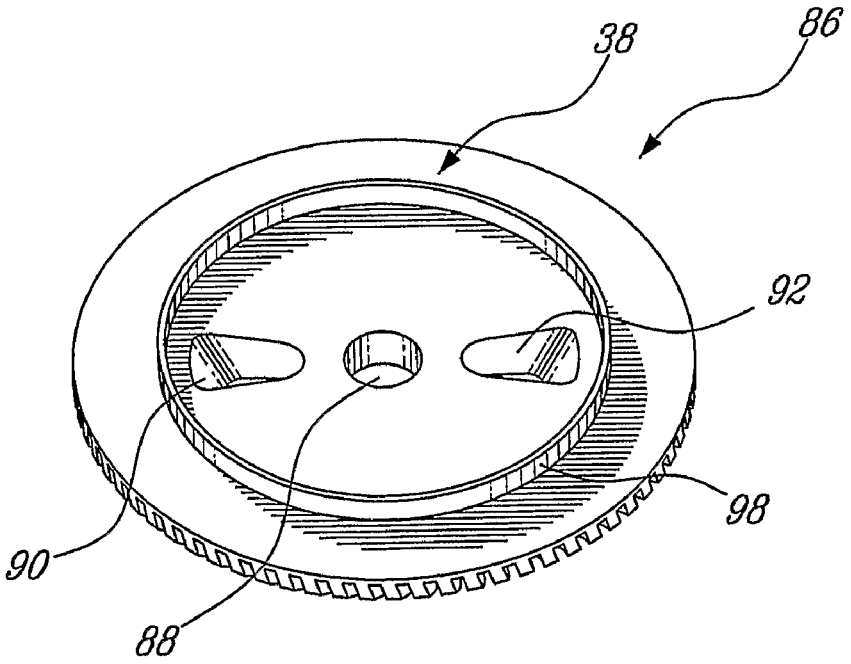
FIG. 12 is a top perspective view of the disc of FIG. 11.
Figure 25:
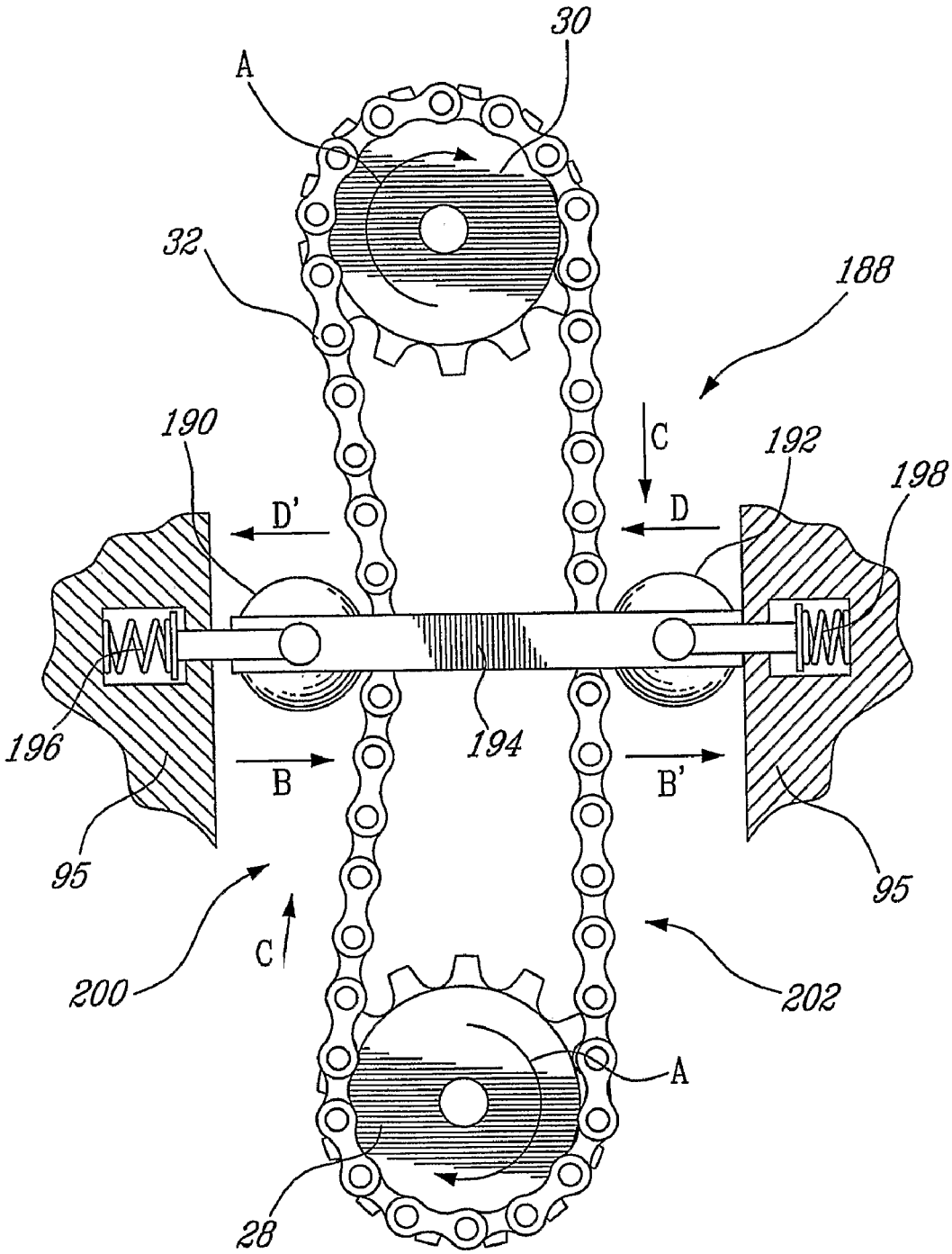
FIG. 25 is a lateral view of the tensioner system in accordance with an embodiment of the present invention.

FIG. 12 shows a top face 38 of disc 86 showing the central aperture 88 as well as the two sequencing ports 90 and 92, which are spaced about the axial centre of rotation. Furthermore, the disc 86 includes a generally circular protrusion or ridge 98 that mates with a complementary indentation 100 (as shown in FIGS. 8 and 25) of the cylinder head manifold 14.

With reference to FIG. 8, the disc 86 is shown to have a circular groove 94, which is a slidable relationship to a circular protrusion 93 of the cylinder box 95.

Figure 21:
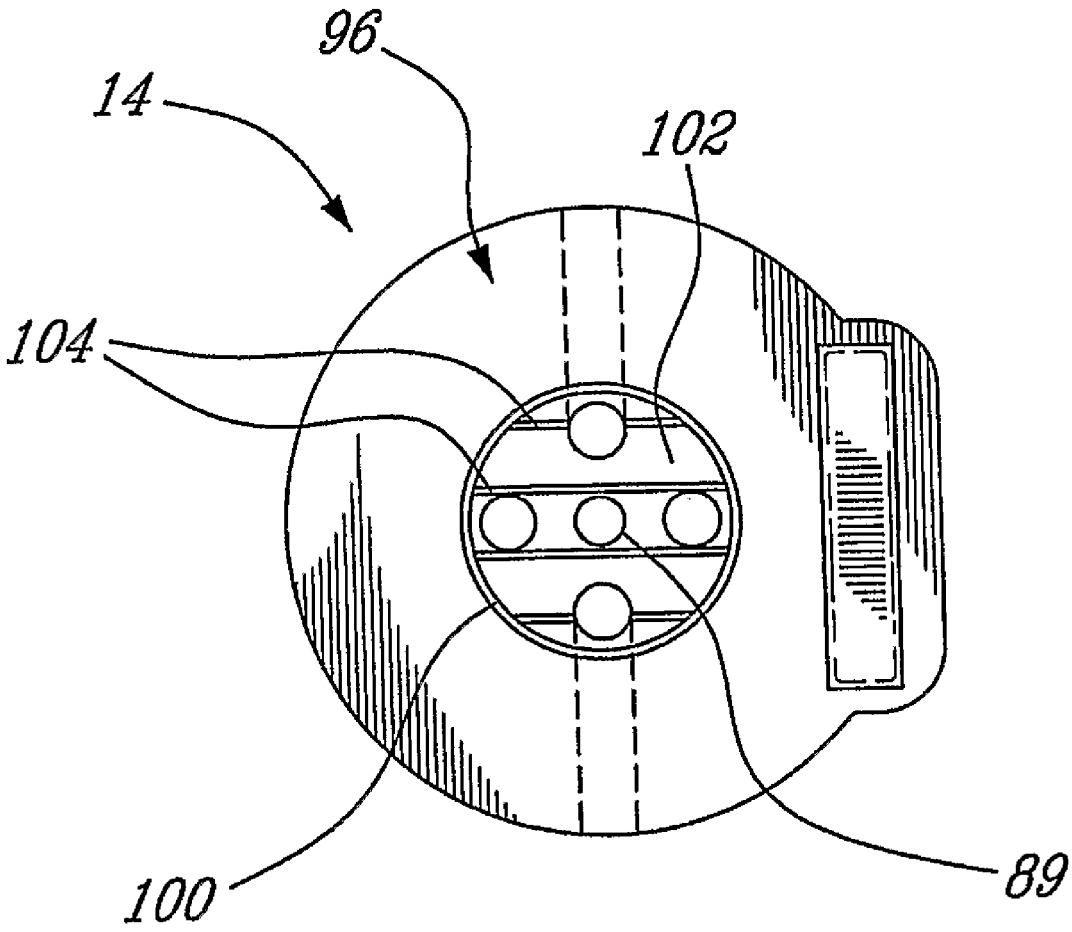
FIG. 21 is a bottom plan view of the cylinder head manifold in accordance with an embodiment of the invention.

With particular reference to FIGS. 8 and 21, the underside 96 of cylinder head 14 has an anti-friction material 102 that is added thereon by a variety of methods and whose shape is configured to be complementary to the top face 38 of disc 86 in such a way as to allow slidable mating between disc 86 and cylinder head 14. This material may be made out of copper for example, yet any type of anti-friction material may be used in the context of the present invention. Furthermore, FIG. 21 shows that this underside 96 of cylinder head 14 can also include hydrostatic elements such as liquid bearings 104 which are channels formed within this anti-friction material. These liquid bearings 104 provide for liquid to pass there through during the rotating movement of a disc such as disc 86. In this way, the liquid bearings provide for lubrication, cooling, cushioning, less friction between a disc 86 and a cylinder head 14, less temperature during operation substantially avoiding overheating as well as providing a longer life span to the cylinder head and discs of the present invention by substantially avoiding damage caused by ordinary wear and tear. The spinning disc valve 86 upper surfaces (or outer face 38) are in slidable contact with the interfacing surfaces 96 of the cylinder head 14. To lessen the frictional load in these areas, shallow channels 104 are machined into the cylinder head surface 96 which allow liquid fuel to flow between the rubbing surfaces and provide lubrication. Hence, a hydrostatic pressure is provided. The depth of these liquid bearings 104 is a function of the amount of fuel and size of the cylinder head 14 and disc 86 used as will be understood by the skilled artisan.

In the embodiment shown in FIG. 8, the spark plug 51 is directly mounted into the cylinder head 14 within aperture 89, which defines a threaded portion, and in this way spark plus 51 does not rotate with the disc 86. Of course instead of a spark plug a fuel injector (not shown) may be mounted in a similar fashion.

With reference to FIGS. 3 and 7, the disc 12 is mounted onto engine cylinder 16 and includes a skirt 44 for covering the top portion of the engine cylinder 16 as well as the intermediate seal member 50. The cylinder box 95 forms shoulders 105, which the skirt 44 can slidably contact; of course the skirt 44 can be shorter and have a free circular end or the shoulder 105 can be shorter and not reach the skirt 44. The spark plug 51 is mounted through aperture 89 directly in a bore or aperture 106 formed by the tubular shaft 48. Of course, instead of a spark plug a fuel injector (not shown) may be mounted in a similar fashion.

Figure 13:
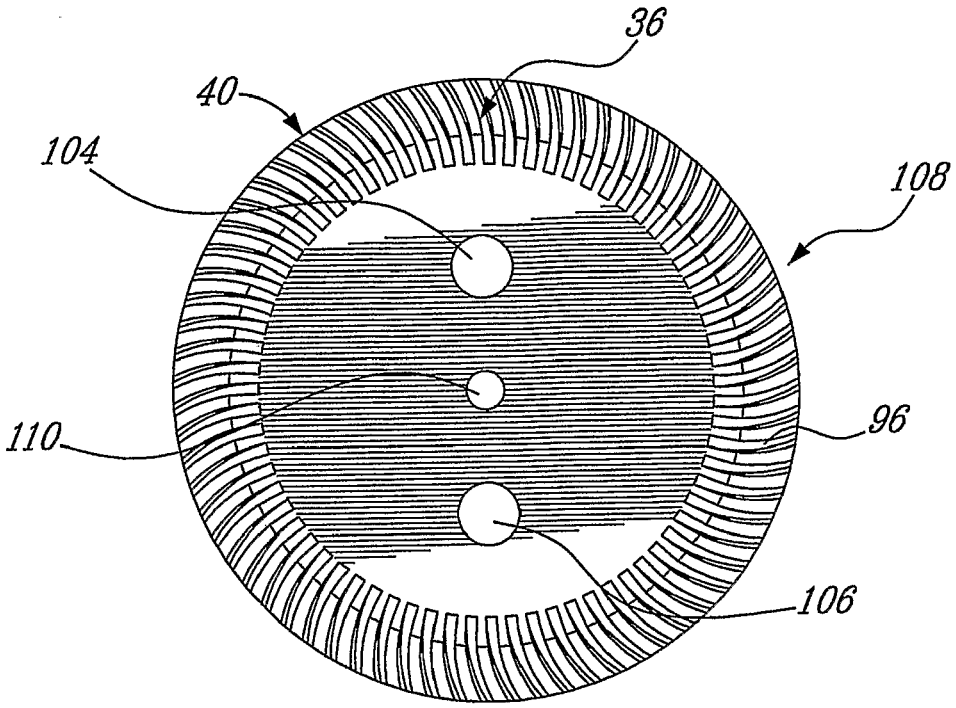
FIG. 13 is a bottom plan view of a disc in accordance with an embodiment of the invention.

FIG. 13 shows a rotating disc 108, in accordance with an embodiment of the invention, which has bevel teeth 36 around its periphery of its underside 40, as well as a central aperture 110 and two sequencing port apertures 104 and 106 respectively, for intake and exhaust, which are on the same rotational orbit or trajectory.

Figure 14:
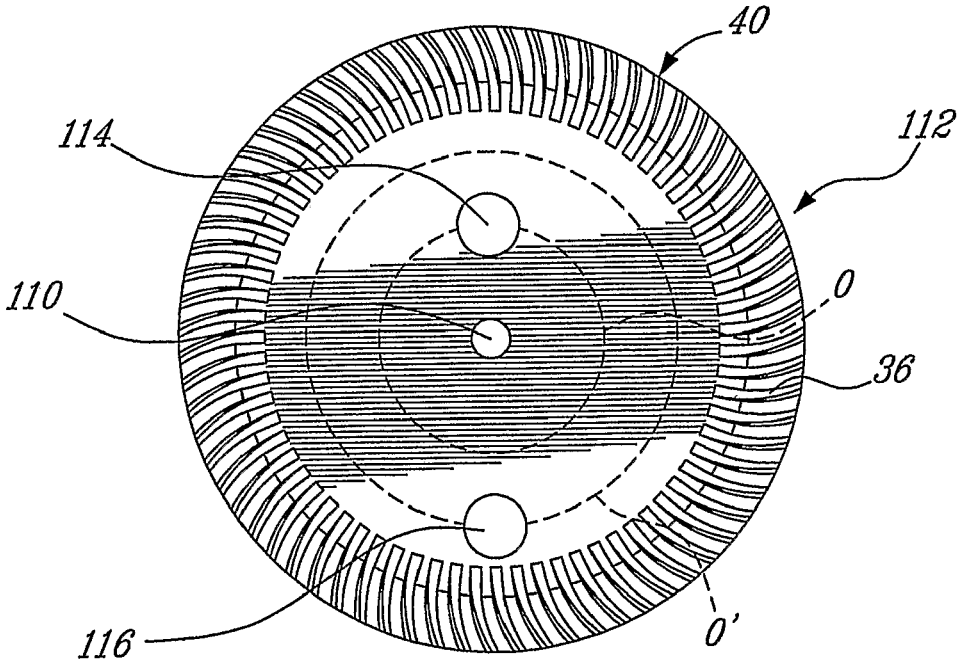
FIG. 14 is a bottom plan view of a disc in accordance with another embodiment of the invention.

FIG. 14 shows a further embodiment of a disc 112, which is similar to the disc 108 described above, yet, in this case, the two sequencing ports 114 and 116 are in different rotating orbits O and O' respectively. In this way, intake and exhaust can be independently regulated as if there were two rotating discs.

Figure 15:
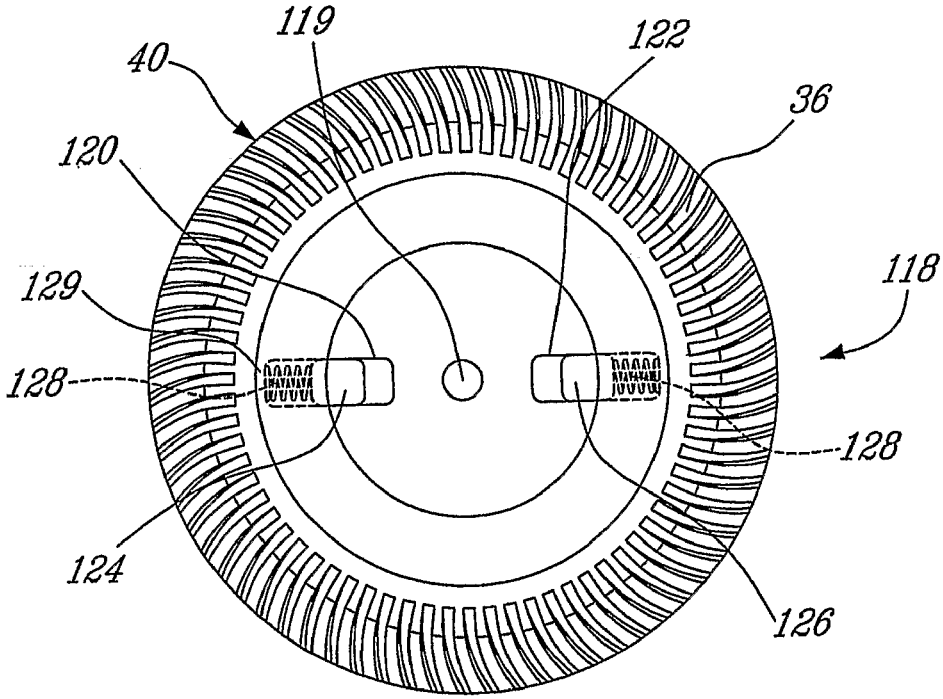
FIGS. 15 and 16 are bottom plan views of a disc in accordance with a further embodiment of the present invention.
Figure 16:
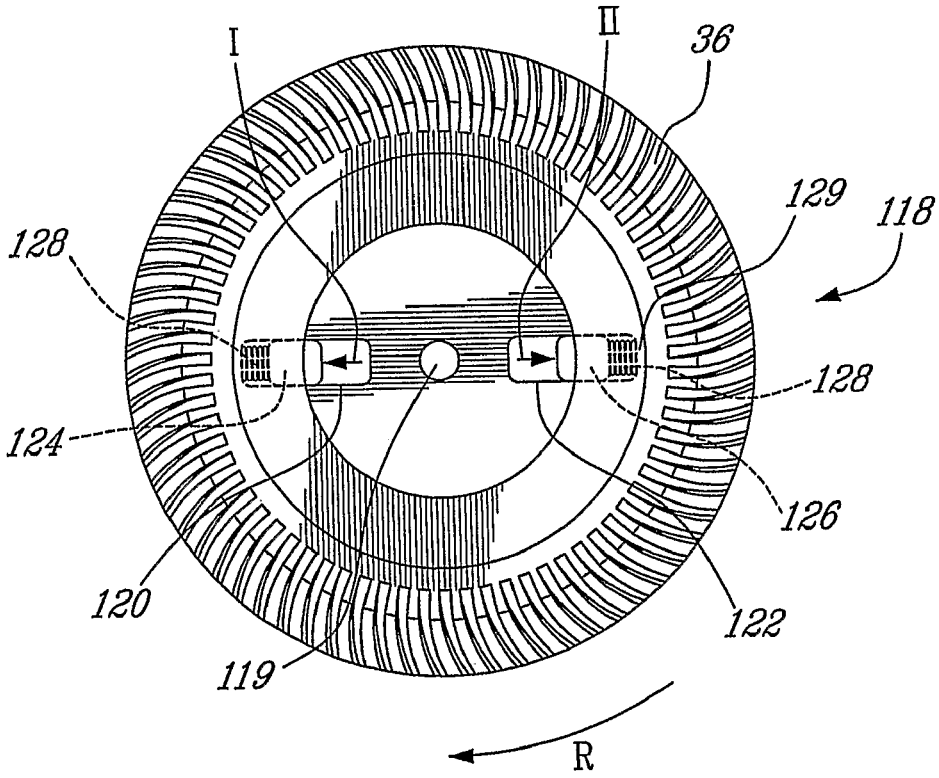

FIGS. 15 and 16 show a rotating disc 118 in accordance with another embodiment of the invention. Again, this disc 118 includes bevel teeth 36 on its underside or inner face 40, and ports 120 and 122. The ports 120 and 122 include respective shutter members in the form of moveable members 124 and 126, which are biased towards an at least partially closed position, as shown in FIG. 15; thus making the aperture defined by ports 120 and 122 smaller via a biasing member 128 in the form of a tension spring mounted to a port wall 129. As shown in FIG. 16, during rotation in the direction shown by arrow R, the shutters 124 and 126, move towards the external periphery of disc 118, as shown by arrows I and II, via a centrifuge action that is dependent on the speed of rotation and such increasing the size of ports 120 and 122. As the rotation of the disc 118 slows down, this centrifuge action will decrease and the biasing force of the tension spring 128 will move the shutters 124 and 126 towards the centre of the disc 118, which includes a generally central aperture 119, hence decreasing the size of ports 120 and 122.

Hence, intake or exhaust will increase with the speed of rotation or via the complementary intake and exhaust ports (such as ports 80 and 84 for example) of a cylinder head 14 meeting with ports 120 and 122 more frequently, and via these ports 120 and 122 becoming larger with the higher rotational speed.

Figure 17:
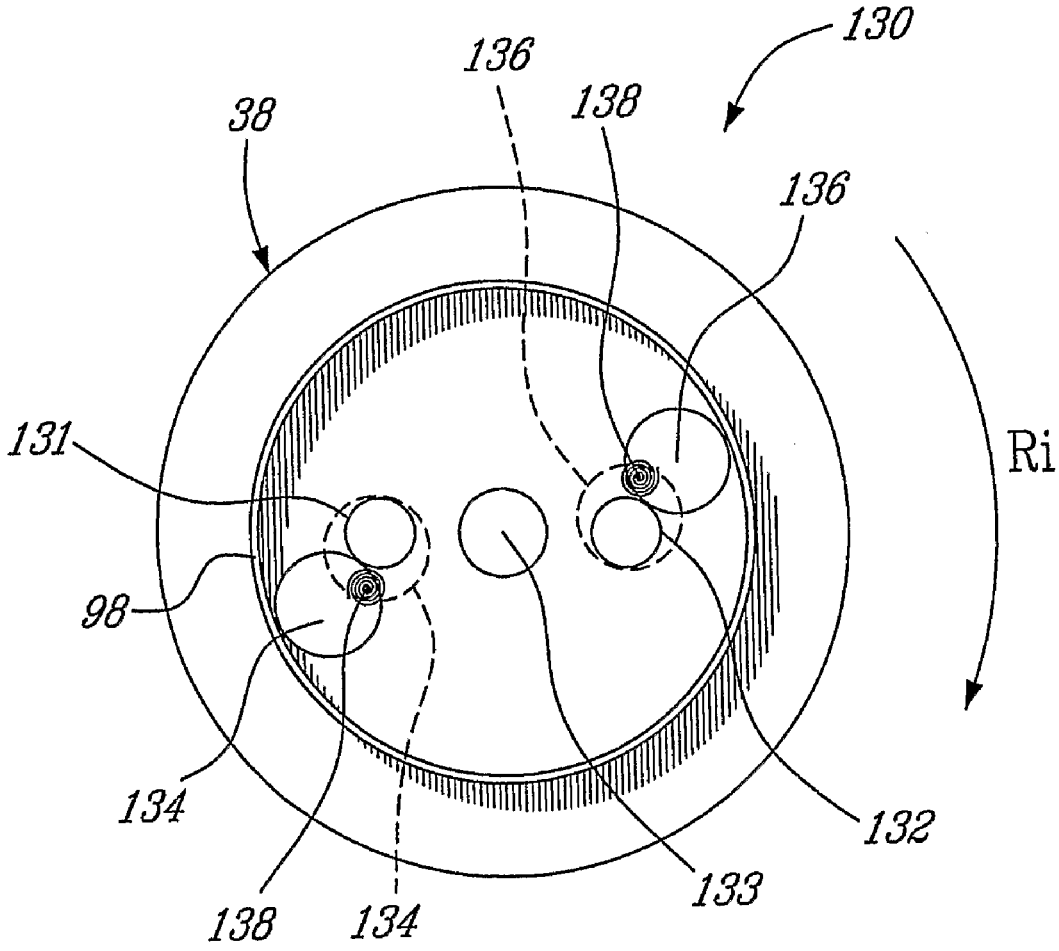
FIG. 17 is a top perspective view of a disc in accordance with yet another embodiment of the invention.

FIG. 17 shows the outer face 38 of a rotating disc 130, in accordance with an embodiment of the invention. The disc 130 includes two ports 131 and 132 a ridge 98 and a central aperture 133. Ports 131 and 132 have shutter members in the form of flaps 134 and 136 respectively. These flaps 134 and 136 are mounted to respective biasing members 138 in the form of a coil mounted to the outer face 38, which bias the flaps 134, and 136 in the closed position shown here in dotted line. As the disc 130 rotates in the direction shown by arrow Ri, the flaps 134 and 136 will move away from ports 130 and 132 due to the centrifugal action, hence increasingly opening ports 130 and 132 as the speed of rotation increases and increasingly closing these ports 130, 132 as the speed of rotation decreases.

Figure 18:
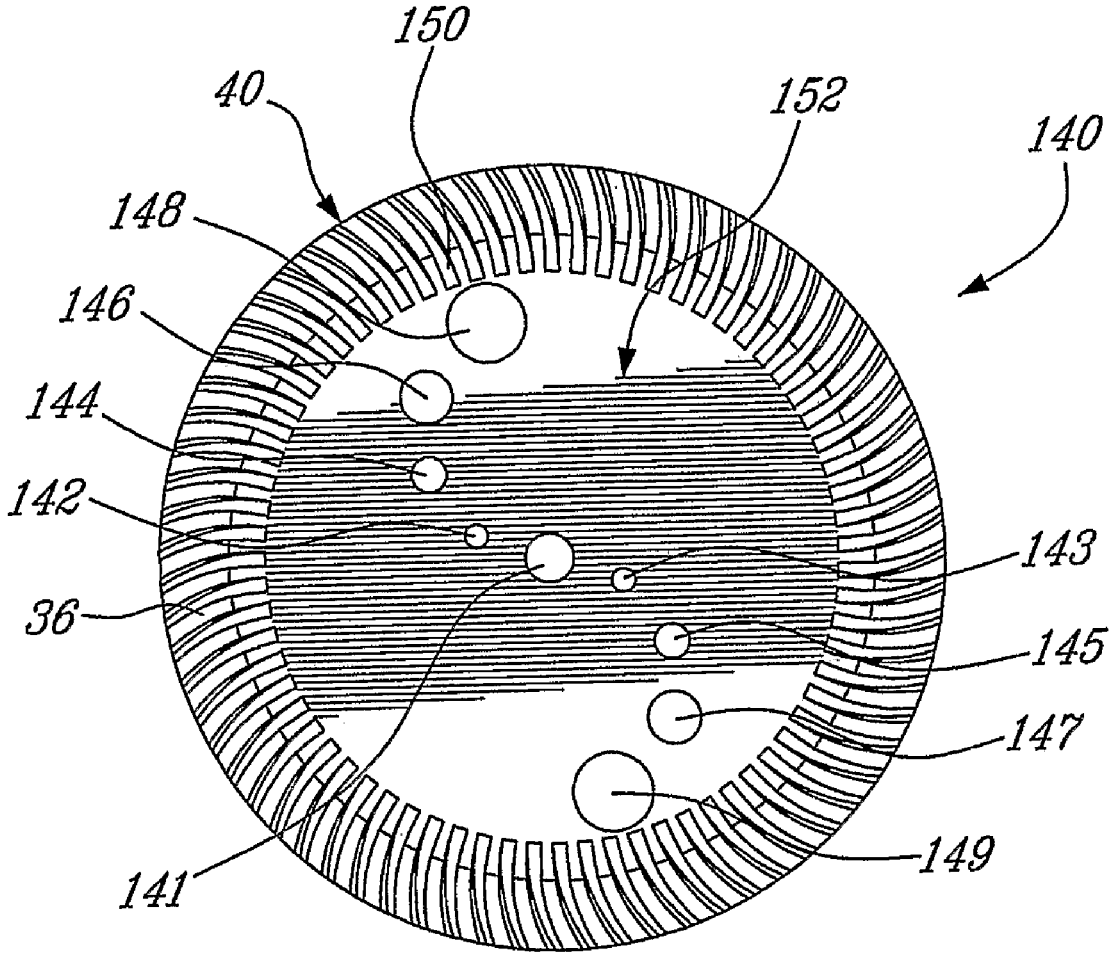
FIG. 18 is a bottom plan view of a disc in accordance with yet a further embodiment of the invention.

FIG. 18 shows disc 140, in accordance with another embodiment of the invention. Disc 140 includes bevel teeth 36 at its inner face or underside 40, a central aperture 141, and a series of ports decreasing in size as they move from the external periphery of the disc 140 towards the centre. These ports are symmetrical with respect to central aperture 141. As shown, there are four ports 142, 144, 146, and 148, at one side of aperture 141, which form a series 150 of exhaust sequencing ports and another four ports 143, 145, 147, and 149, at the other side of central aperture 141, which form a series 152 of intake sequencing ports. As shown, the following pairs of ports 142 and 143, 144 and 145, 146 and 147, 148 and 149 are mirror images of each other and at an equal distance from the central aperture 141. Hence, intake and outtake can be regulated by varying the rotational speed of the disc. In this way the smaller ports are either given enough time for proper intake or exhaust or prevented from doing so.

Of course, the series of a plurality of exhaust or intake sequencing ports can include ports of varying sizes in a respective series depending on how the skilled artisan wishes to design the cylinder head and what kind of timing and amount of intake or exhaust the ordinarily skilled artisan wishes to achieve.

Figure 19:
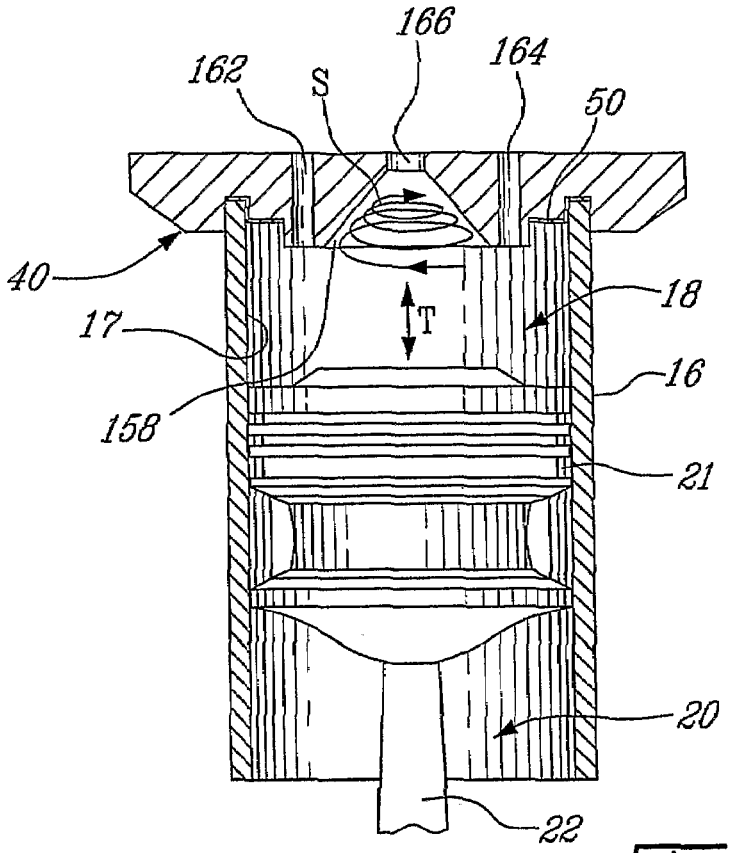
FIG. 19 is a partial sectional view of the disc valve system in accordance with yet another embodiment of the invention.
Figure 20:
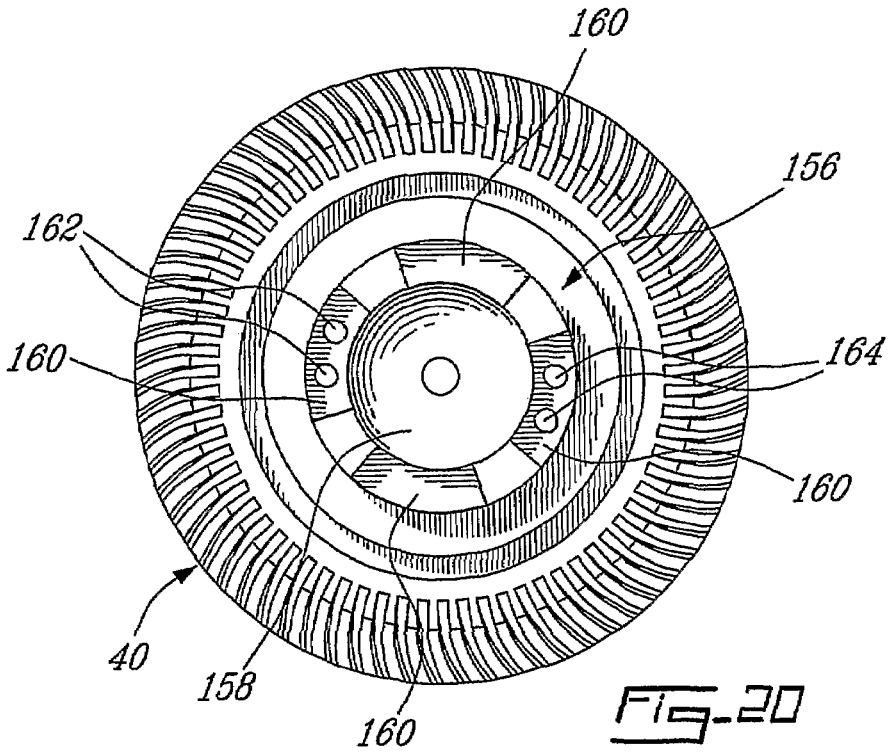
FIG. 20 is a bottom perspective view of a rotating disc valve in accordance with yet another embodiment of the invention.

FIGS. 19 and 20 show a disc 154 in accordance with a further embodiment of the present invention.

Disc 154 includes a turbulator portion 156 at its inner face 40 configured to provide for turbulence thereunder during the rotating movement of said disc 154 as shown by arrow S. The turbulator portion includes a receding portion 158 in the inner face 40 as well as propeller members 160 (in this example there are four such members) in the form of generally circular blade members. In this non-limiting example, sequencing intake ports 162 and sequencing exhaust ports 164 define apertures through these blades 160. The intake and exhaust ports 162 and 164 are symmetrical about a generally central aperture 166. This generally central aperture provides communication with an ignitor such as a fuel injector, a spark plug and the like.

In accordance with the present invention, the disc valve engine, such as E, can operate on a variety of alternative fuels. This diversification is achieved with only slight modification since the induction and exhaust circuits are combined in a single disc and operate in a single rotational motion relative to stationary cylinder head ports (80 and 84, for example). Modification is easily accomplished by changes in the angular positioning and in dimensioning of the relative matching disc and cylinder head port opening.

Combustion in the disc valve engine E is mechanically facilitated by the swirling motion S generated in the combustion chamber 18 by the high speed rotation of the disc valve 154 below the cylinder head 14, which increases the turbulent mixing prior to spark ignition. Swirling turbulence S is intensified by the placement of small propelling blade 160 members that are machined around the disc valve 154 conical opening 158 that protrudes from the disc undersurface 40.

In diesel engine design autoignition and combustion efficiencies are enhanced by injecting into a conical volume 158 formed in the center of the disc valve 154. The rotational velocity of the swirling charge S is the same at every axial station within the conical section 158 since the swirling motion S is induced by the rotation of the disc 154. But air tangential or circular velocity decreases proportionally with decreasing conical diameter, thereby increasing the temperature at the point of fuel injection. Increase in system temperature at the point of fuel injection and induced turbulent mixing will increase atomization and combustion efficiency.

Gasoline Disc Valve Engine: In small high-speed spark ignition disc valve engines E, the major source of unburned hydrocarbons, assuming a complete homogeneous charge, is cylinder wall 17 (see FIG. 24) quenching, incomplete combustion, and inefficient exhaust evacuation. These anomalies are alleviated in the disc valve engine system E, which operates in a high or temperature regime, which facilitates fuel volatility and subsequent mixing and is dynamically augmented by mechanical disc 154 rotation.

Diesel Disc Valve Engine: The disc valve engine constant volume Otto cycle is easily converted to the constant pressure Diesel cycle. This is achieved by replacement of the engine ignition spark plug (51) with a fuel injector (not shown).

Unlike the homogenous mixture of fuel and air on the constant volume combustion in gasoline engines the constant pressure combustion of diesel engines is heterogeneous and occurs as droplet surface burning phenomena producing a different mixture of emissions than that obtained in gasoline engines. In the diesel engine autoignition can occur at several locations in the combustion chamber 18, while in other portions of the chamber the fuel may still be in the liquid phase.

The distribution of the fuel within the combustion field has a great effect on the combustion mechanism and most certainly effects the emissions formed. The undesirable emissions to be regulated are unburned hydrocarbons, aldehydes, carbon monoxide, smoke particles and nitrogen oxides. The technical approach to reducing these harmful emissions is by configuring the combustion chamber 18 to achieve efficient mixing during combustion.

Combustion Chamber Design: Turbulence in the combustion chamber and good spray formation are the most important parameters in the design of high performance low emission diesel engines. Turbulence is most often created by radial flow compression in conventional engines called squish.

In the disc valve engine E turbulence is generated as a radial swirl S. This motion is carried upward in a spiral by conically configuring the disc toward the point of fuel injection The compressive flow in the Disc valve combustion chamber is seen as comprising a tangential as well as a radial component. The radial flow is caused principally by piston compression T and the tangential swirl S is caused by the spinning disc valve. The two components of radial and tangential flow result in a vectored upward circular path which when compressed in the conical volume generates an upward climbing spiral which terminates at the injector opening 166.

When the engine piston has reached TDC the upward squishing action ceases and fluid momentum reacts against the turbulator blades producing an augmenting torquing force in the same direction as the disc valve rotation which alleviates the frictional load.

As will be ascertained by the ordinarily skilled artisan, the shapes, number, size and general configuration of the sequencing ports can be varied for a variety of intake or exhaust needs. Furthermore, the disc valve of the present invention can be configured and sized depending on the disposition of ports thereon; depending on the sequencing time for mating the disc ports with the cylinder head ports, thereby modulating outtake and exhaust time; depending on the geometric shape of the disc and on the material it is made from. Furthermore, the ordinarily skilled artisan will understand that the various features of the various disc valves of the invention can be combined in a variety of ways depending on what advantages or objects the skilled artisan wishes to achieve. Hence, all the features of the disc valves described and illustrated herein as well as the alternative embodiments thereof can be mosaiced in different ways in order to produce alternative embodiments of the disc valves of the present invention.

Figure 22:
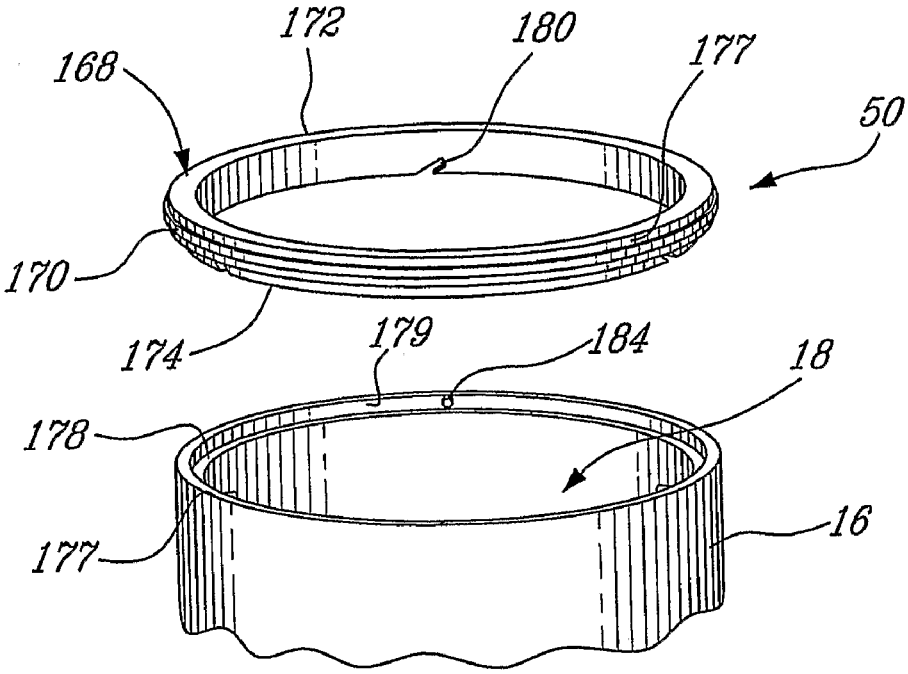
FIG. 22 is a perspective view of an intermediate seal member and the top of a piston cylinder in accordance with an embodiment of the invention.
Figure 23:
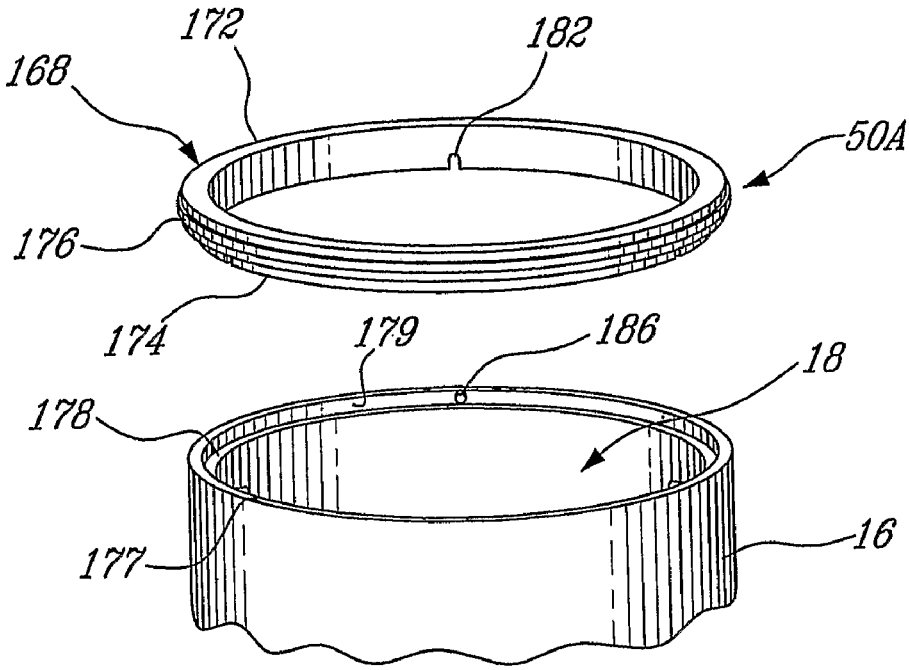
FIG. 23 is

Turning to FIGS. 22 and 23 and with reference to FIGS. 7 and 8, there is illustrated intermediate seal members 50 and 50A for mounting between the rotating disc valves of the invention and the engine cylinder 16 so as to seal the combustion chamber 18 at a junction of the rotating disc and the engine cylinder 16.

The intermediate seal member comprises a dynamic seal 168 for contact with said rotating disc, such as 12 for example, and a stationary seal 170 for sealing contact with the engine cylinder 16.

The intermediate seal members 50 and 50A are in the form comprise an upper face 172, a bottom face 174 and an intermediate surface 176. In this example, the intermediate seal members are in the form of rings.

Ring seals effectively seal the combustion chamber 18 defined by the engine cylinder 16 by forming a dynamic sliding seal with the rotating disc 12 and a static or stationary seal with the engine cylinder 16 within the limiting axial distance of the combustion volume when the engine piston 21 is at top dead centre at the end of its compression stroke.

In previous designs and proprietary illustrations, the stationary sealing contact has been in the cylinder head. The stationary seal of the intermediate rings 50 and 50A of the present invention is at the engine cylinder inside surfaces 178.

Ring members 50 and 50A include the stationary seal 170 at the intermediate surface 176. In this embodiment, the stationary seal is an o-ring extending beyond surface 176 and slidably held within a groove machined at the outer perimeter of surface 176.

The bottom faces 174 of ring seals 50 and 50A are configured to be fitted within the cylinder 16 and mate with the inner top surface 178 thereof. Furthermore, the bottom faces 174 (or edges) include locking members 158 in the form of a recess. Ring seal 50 includes an inclined recess 180 whereas ring seal 50A includes a straight recess 182. Recesses 180 and 182 are formed to accept complementary locking members in the form of pins 184 and 186 at the inner top perimeter surface 178 of cylinder 16 for holding the intermediate ring seals 50 and 50A in place and preventing their rotation.

Since, the top faces 172 of both ring seals 50 and 50A are in a dynamic seal contact with any of the disc valves of the present invention, they provide for the disc valves to rotate with respect thereto.

The stationary seal 170 is in sealing relationship with rim 179 of the cylinder 16. This relationship is clearly shown in FIGS. 7 and 8.

The bottom face 174 of each ring seal 50 and 50A is in a static stationary seal within the cylinder 16. The top internal periphery 178 of the piston cylinder 16 is recessed and forms a seating arrangement that is complementary to a given bottom face 174 in order for the rings 50 or 50A to be seated thereon in sufficient fit.

An aspect of this invention is the method of sealing the combustion chamber of a rotary disc valve engine between the cylinder head and the engine cylinder. At the cylinder 16 the intermediate ring seal 50 or 50A provides a static seal with the engine cylinder 16 by a seal 170 operating within a seal groove 171 (see FIG. 7) machined into the outer surface 176 of the intermediate ring seal 50 or 50A. Therefore, the intermediate ring seal 50 or 50A comprises both dynamic and static sealing characteristics as a sealing interface between the rotating surfaces of the disc valve and stationary sealing surfaces of the engine cylinder 16.

In an embodiment, the stationary seal mates with the external rim 177 of the cylinder 16.

Dynamic and static sealing between the rotating disc valve and stationary engine cylinder 16 occurs within the limited axial length of the combustion volume.

In an embodiment, to alleviate this restrictive spatial requirement a skirt 44 extension can be added to the disc valve 12, which extends the axial length of the sealing contact between the dynamic seal and stationary seal without changing the combustion volume which would change the engine compression ratio and alter its performance. Hence, in one embodiment, this sealing is achieved by the skirt 44 which extends from the underside 40 of disc 12 and extends over the engine cylinder 16, as clearly shown in FIGS. 1, 2 and 7 for example, and as such, allowing for an intervening space for the intermediate ring 50 or 50A to seal against the engine cylinder 16.

An aspect of the invention is the extension of the axial distance between the dynamic seal and stationary sealing surfaces such that they overlap the interface between the cylinder head 14 and engine cylinder 16, facilitating engine component manufacture and installation of the cylinder head 14 on the engine cylinder 16 with improved sealing reliability. The seals 50 and 50A provide for sealing the combustion volume of a disc valve engine E. The seals 50 or 50A provide dynamic sealing against the sliding surfaces of the disc valve and also provide static seal with the engine cylinder. These seals are effective in the limiting axial length of the combustion volume measured as the distance between the engine piston crown or head 21 and the cylinder head 14 surface configured within the confining surface of the disc valve. To facilitate the sealing function the intermediate ring seal is designed to overlap the interface between the engine cylinder head 14 and engine cylinder 16. A purpose of the intermediate seal 50 or 50A is to confine the working fluids, being acted upon by the reciprocating motion of the engine piston 20, across the stationary interface of the engine cylinder 16 and rotative surface of the disc valves of the invention. The present seals 50 and 50A are dynamic and hence, there is minute vertical tremble during the translational movement T of the piston 20. The intermediate seal members of the invention provide for combustion to take place.

Figure 24:
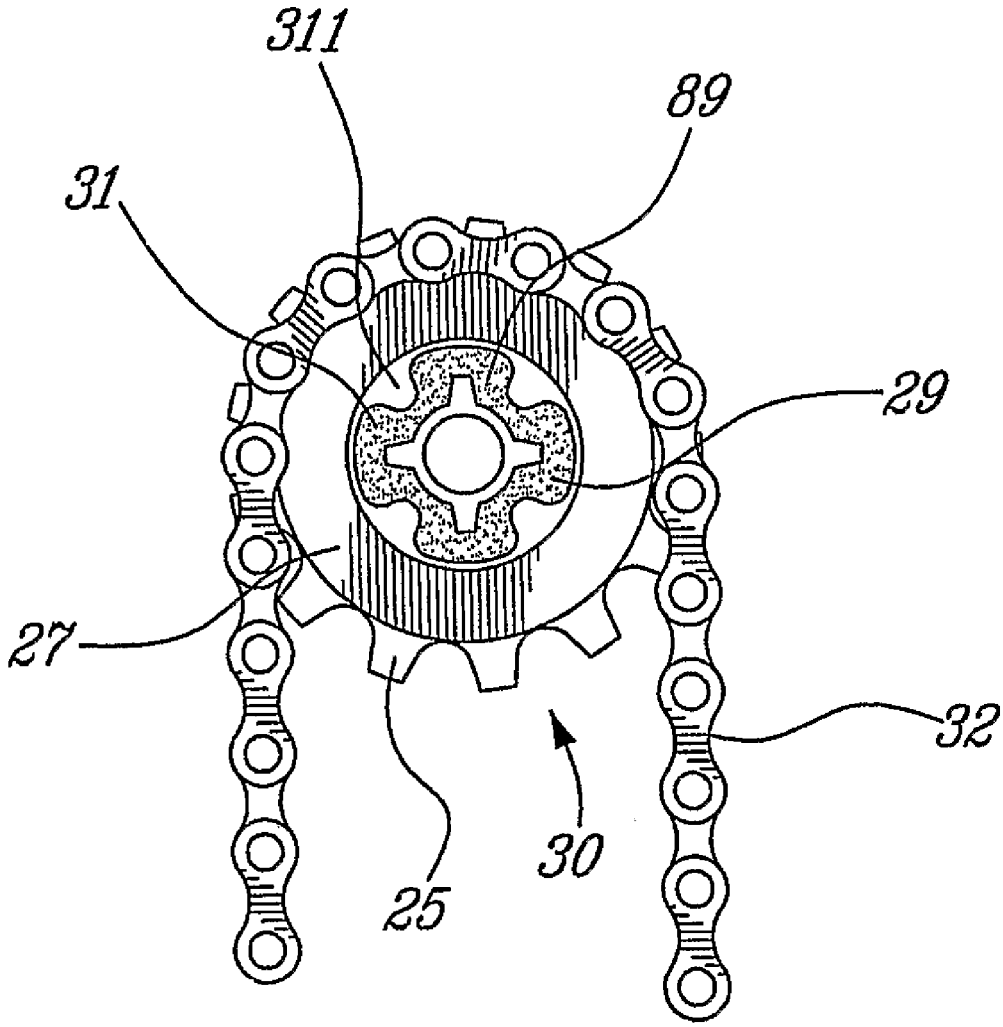
FIG. 24 is a lateral view of the top timing gear of the disc valve system in accordance with an embodiment of the invention.

With particular reference to FIG. 24 and general reference to FIGS. 1, 6, 7 and 8, there is shown the second sprocket gear 30 including a hub 27, which holds a resilient member 29 as well as external teeth 25 on which chain 32 is mounted to. The sprocket gear 30 functions as a timing gear for the disc valve system 10. This timing gear 30 has a hub 27 that is aligned concentrically about the axis of rotation of gear 30. The hub 27 holds a resilient member 29 that is fixedly secured by a plurality of matching interfacing sector contours 31 configured in this resilient member 29, and that is correspondingly contoured 311 in the hub 27. The timing gear 26 is rotatably mounted on the timing shaft 35. As mentioned above, the timing shaft 35 comprises bevel gear 33 fixedly attached to one end thereof. The resilient member 29 can be made by a variety of natural or synthetic rubbers.

This hub 27 with the resilient member 29 serve a flexible coupling between the gear 30 and the shaft 35. This flexible coupling is used to provide a shaft to work flexibly under heavy starting loads or to offset a shaft misalignment. The resilient member 29 provides a means for lowering big friction loads at the sliding interface between the stationary stator surface and the surface of the rotating disc 12 operating within the fluctuating pressure field of the engine combustion chamber 18. Rotation of the disc 12 within the engine combustion chamber 18 periodically opens and closes a plurality of exhaust and intake ports (80 and 84) in the stationary stator of the engine cylinder head 14 in a sequential manner corresponding to the alternating order of the engine through one or more dynamic pressure cycles. The flexible coupling between the timing gear 30 and the timing shaft 35 momentarily slows the rotational velocity of the disc 12 during the highest peak pressure of the engine combustion stroke at the point of the ignition spike thereby reducing the sliding contact frictional energy between the disc 12 and the stator surfaces, which is exponentially at its highest point during this brief period. At the few milliseconds of peak combustion pressure, ignition spike the resilient member 29 between the hub 27 of the timing gear 30 and the timing shaft 35 is slightly compressed causing the timing shaft 35 to rotate slower than the timing gear 30 for a brief instant over a small millisecond increment of a rotation and thereby transmitting a slowing motion to the disc 12 rotation. This slowing motion is hardly measurable but at the molecular interface of the lubricating film between the surfaces and slidable contact, the shearing impact across the interface is lessened exponentially as a function of the contact and velocity. Absorption of peak torque loads on the timing shaft by the resilient member 29 during the peak combustion pressures when the sliding contact friction between the disc 12 and the stator are highest, will lessen wear between the two surfaces and lower the potential for galling.

The resilient member 29 is an elastic material capable of fully responding over the engine operating frequency. Formulation of rubber resilient members with extenders or catalyst accelerators will stiffen the response in a manner that permits full recovery after each compression and will not couple with the engine's natural frequency. The resilient member 29 may be manufactured from any material that has the physical properties of sustained response of rapid compression loads with rapid recovery and good storage durability with long-term fatigue capability under heavy loads.

In another embodiment, the first sprocket gear 28 includes a resilient member 29, in still another embodiment, both sprocket gears include resilient members 29

FIG. 25 shows a tensioner system 188 that is used on chain 32, which acts on the bottom and top sprocket gears 22 and 26. This tensioner system 188 includes first and second tension elements 190 and 192 which are linked together via a dynamic member 194 such as a rod, a spring, an elliptical ring, or by solid rod and in this case the tension elements 190 and 192 are mounted to the cylinder box 95 via spring members 196 and 198 respectively. The tensions elements 190 and 192 may also be mounted via flexible resilient members to the dynamic member 194. When the sprockets 28 and 30 turn as shown by arrows A and the chain is in movement, as shown by arrows C it will act on the tensioner system 188. One side 200 of the chain 28 will act on tension element 190 and as such element 190 will pushes chain side inwards as shown by arrow B, the dynamic member 194 will push tension element 192 in the same direction B'. The foregoing will cause the dynamic member 194 or the biasing members 196 and 198 mounted to tension elements 190 and 192, via an equal and opposite reaction to the movement represented by arrows B and B', to act on tension element 192 to push side 202 of the chain 32 inwardly, as shown by arrow D, simultaneously the dynamic member 194 will push the tension element 174 in the same direction as shown by arrow D'. This reciprocating movement represent by arrows, B, B' and D, D' causes the second gear 30 to slow down or rotate in a non-constant speed, which has the same effect on the disc 12, hence slowing down a given intake or outtake port on the disc 12 from meeting its complementary outtake or intake aperture on a cylinder head 14, in such a way as to cause a non-uniform sequencing by causing this, periodic tension on the chain 32.

Engines start easier at high compression. For increased operating reliability the disc valve engine timing is designed for high compression starting at retarded intake and exhaust port openings. At high speed operation dynamic flow losses and system resistances in the manifolding circuits are alleviated by early intake and exhaust port opening increasing the engine efficiency by advancing the effective period of the power cycle under load. Valve timing improves the engine reliability and efficiency, including easier starting, higher operating speed and increased load capacity.

Figure 26:
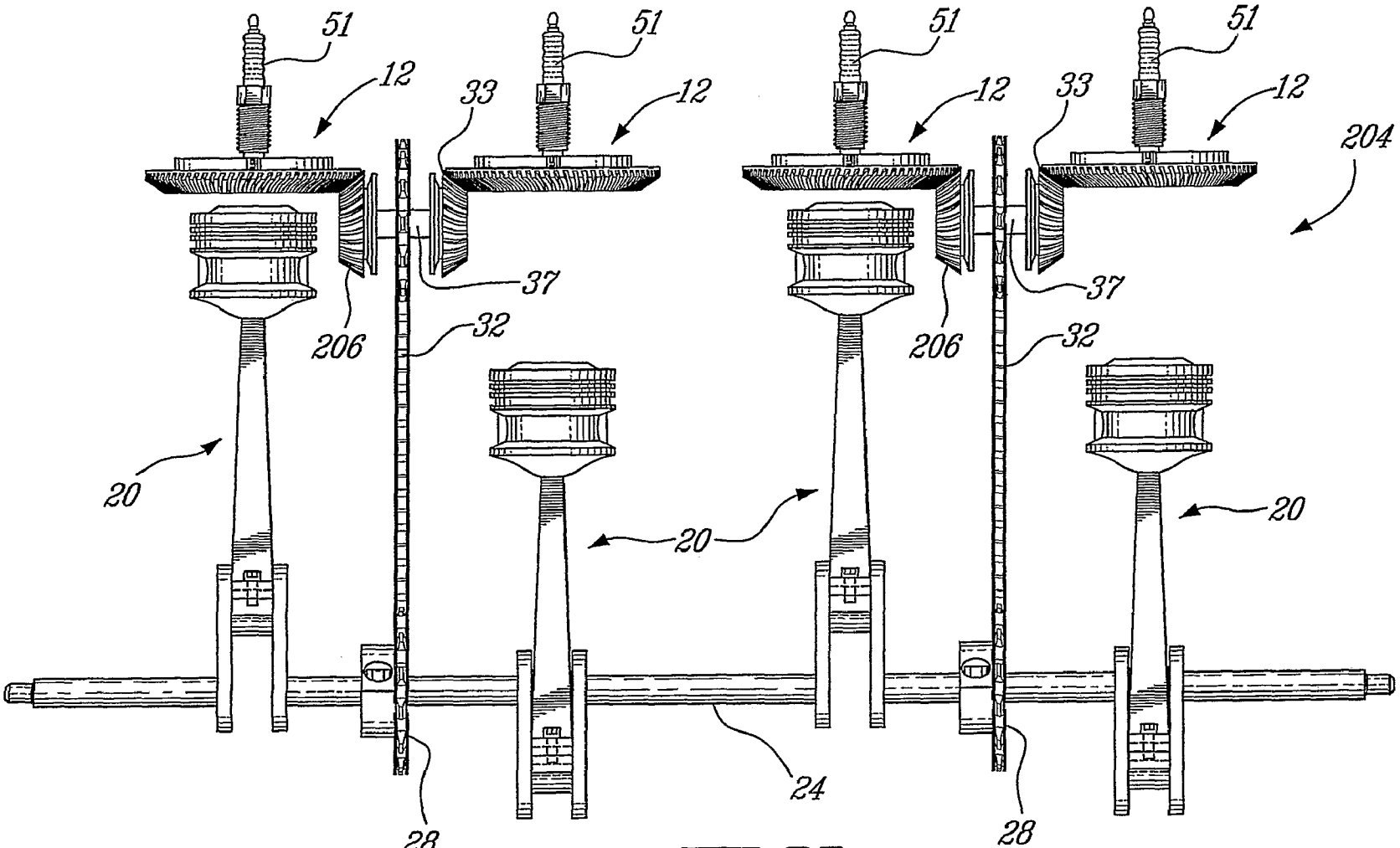
FIG. 26 is a front view of a disc valve system for a multi-piston engine in accordance with an embodiment of the invention.

FIG. 26 shows a disc valve system 204 which includes a plurality of discs 12 for respective cylinder heads (not shown). The disc valve system 204 includes a crankshaft 24 on which are rotatably mounted multiple piston 20. The crankshaft 24 includes at least 2 gears 28 in communication with a movement-transfer assembly such as chain 32. Each chain 32 is in operative communication to a rotating shaft 37 that has on one end thereof a pinion gear 33 and an opposite pinion gear 206 at another end thereof. Pinion gears 33 and 206 act on respective discs 12. In this way, the disc valve system 204 provides for a multi piston cylinder engine to be used with the novel features of the present invention. Of course other types of multi-piston engines comprising the disc valve systems and the features thereof can be contemplated by the skilled artisan in accordance with the present invention.

It is to be understood that the invention is not limited in its application to the details of construction and parts illustrated in the accompanying drawings and described hereinabove. The invention is capable of other embodiments and of being practiced in various ways. It is also to be understood that the phraseology or terminology used herein is for the purpose of description and not limitation. Hence, although the present invention has been described hereinabove by way of embodiments thereof, it can be modified, without departing from the spirit, scope and nature of the subject invention as defined in the appended claims.

What is claimed is:

1. A disc valve system for a piston driven internal combustion engine, said disc valve system comprising:

at least one rotating disc for mounting between a cylinder head manifold comprising exhaust and intake ports and an engine cylinder housing the piston and defining a combustion chamber, said rotating disc comprising sequencing ports so configured as to be brought into periodic communication with said exhaust and intake ports at cyclic intervals of the rotating movement of said rotating disc thereby providing for said exhaust and intake ports to be brought into periodic communication with said combustion chamber; and an intermediate seal member for mounting in the engine cylinder at a junction of said rotating disc and the engine cylinder so as to seal the combustion chamber, said intermediate seal member comprising a dynamic seal for contact with said rotating disc and a stationary seal for sealing contact with the engine cylinder;

whereby the rotating movement of said rotating disc sequentially opens and closes each said exhaust and intake ports synergistically with the translational movement of the piston.

2. A disc valve system according to claim 1, wherein said disc comprises a generally central aperture for being in alignment with an aperture of the cylinder head manifold.

3. A disc valve system according to claim 2, wherein said cylinder head manifold aperture is defined by a spark-plug receiving portion.

4. A disc valve system according to claim 3, wherein said spark-plug receiving portion defines a threaded portion for fixedly receiving a spark-plug.

5. A disc valve system according to claim 2, wherein said cylinder head manifold aperture is defined by a fuel-injector receiving portion.

6. A disc valve system according to claim 5, wherein said fuel-injector receiving portion defines a threaded portion for fixedly receiving a fuel injector.

7. A disc valve system according to claim 1, wherein said disc comprises an outer face in a slidable sealing relationship with the cylinder head manifold and an opposite inner face in a slidable relationship with said intermediate seal member.

8. A disc valve system according to claim 7, wherein said outer face comprises a generally central protrusion for slidably mating with a complementary indentation within the cylinder head manifold.

9. A disc valve system according to claim 8, wherein said generally central protrusion comprises a tubular shaft.

10. A disc valve system according to claim 9, wherein said tubular shaft defines an aperture for fixedly receiving a spark plug.

11. A disc valve system according to claim 9, wherein said tubular shaft defines an aperture for fixedly receiving a fuel injector.

12. A disc valve system according to claim 7, wherein said outer face comprises a generally circular protrusion for slidably mating with a complementary indentation comprised by the cylinder head manifold.

13. A disc valve system according to claim 12, wherein said complementary indentation is defined by a layer of material added on the cylinder head manifold.

14. A disc valve system according to claim 13, wherein said layer of material is selected from the group consisting of: copper and anti-friction material.

15. A disc valve system according to claim 12, wherein said complementary indentation is formed within the cylinder head manifold.

16. A disc valve system according to claim 7, wherein said inner face comprising a turbulator portion configured to provide for turbulence thereunder during the rotating movement of said disc.

17. A disc valve system according to claim 16, wherein turbulator portion further comprises propeller members.

18. A disc valve system according to claim 16, wherein said turbulator portion comprises a receding region within said inner face.

19. A disc valve system according to claim 18, wherein turbulator portion further comprises propeller members about said receding portion.

20. A disc valve system according to claim 19, wherein said propeller members comprise blade members.

21. A disc valve system according to claim 20, wherein said blade members are generally circular shaped.

22. A disc valve system according to claim 19, wherein said sequencing ports comprise apertures which through said propeller members.

23. A disc valve system according to claim 18, wherein said receding region is generally conical shaped.

24. A disc valve system according to claim 7, wherein said inner face comprises a skirt portion for mating with the engine cylinder.

25. A disc valve system according to claim 24, wherein said skirt portion and the cylinder engine comprise a sealing material therebetween.

26. A disc valve system according to claim 1, wherein said rotating disc comprises gear elements.

27. A disc valve system according to claim 26, wherein said gear elements comprise bevel teeth.

28. A disc valve system according to claim 26, wherein said rotating disc comprises an inner face comprising said gear elements.

29. A disc valve system according to claim 28, wherein said gear element is formed near the periphery of said rotating disc.

30. A disc valve system according to claim 1, wherein said cylinder head manifold and said disc comprise a sealing material therebetween.

31. A disc valve system according to claim 1, wherein said sequencing ports comprise at least one intake sequencing port and at least one exhaust sequencing port.

32. A disc valve system according to claim 31, wherein during the rotating movement of said disc, said intake sequencing port is brought into periodic communication with said cylinder head intake port and said exhaust sequencing port is brought into periodic communication with said cylinder head exhaust port.

33. A disc valve system according to claim 32, wherein said at least one intake sequencing port and at least one exhaust sequencing port are moved by the rotating movement of said disc along a same orbital.

34. A disc valve system according to claim 32, wherein said at least one least one intake sequencing port and at least one exhaust sequencing port are moved by the rotating movement of said disc along different respective orbitals.

35. A disc valve system according to claim 1, wherein said sequencing ports comprise apertures.

36. A disc valve system according to claim 35, wherein said sequencing ports comprise respective shutter members.

37. A disc valve system according to claim 36, wherein said shutter are so biased as to at least keep said port apertures partially closed.

38. A disc valve system according to claim 37, wherein said shutters are moveable towards a position that progressively opens said port apertures during the rotating movement of said disc.

39. A disc valve system according to claim 38, wherein a said shutter comprises a moveable member positioned within said aperture, and mounted to a port wall via a biasing member.

40. A disc valve system according to claim 39, wherein said biasing member comprises a spring.

41. A disc valve system according to claim 36, wherein said shutters comprise flaps which are mounted to said disc via a biasing member so biasing said flaps as to at least substantially cover said sequencing port apertures.

42. A disc valve system according to claim 41, wherein said biasing member comprises spring.

43. A disc valve system according to claim 1, wherein said sequencing ports comprise a plurality of intake sequencing ports and a plurality of exhaust sequencing ports.

44. A disc valve system according to claim 43, wherein said plurality of intake and exhaust sequencing ports are disposed in respective intake and exhaust series on said rotating disc.

45. A disc valve system according to claim 44, wherein said series of said plurality of intake sequencing ports comprises intake ports of different dimensions.

46. A disc valve system according to claim 45, wherein said plurality of intake sequencing ports comprises sequencing ports that increase in size in the direction from the centre of said disc to the periphery of said disc.

47. A disc valve system according to claim 44, wherein said series of said plurality of exhaust sequencing ports comprises exhaust ports of different dimensions.

48. A disc valve system according to claim 47, wherein said plurality of exhaust sequencing ports comprises sequencing ports that increase in size in the direction from the centre of said disc to the periphery of said disc.

49. A disc valve system according to claim 1, wherein the cylinder head manifold comprises liquid bearings on a portion thereof that is in contact with said disc.

50. A disc valve system according to claim 49, wherein said liquid bearings comprise channels formed within said cylinder head manifold portion.

51. A disc valve system according to claim 50, wherein said cylinder head manifold comprises a material plated on said portion, said liquid bearings comprising channels formed within said plated material.

52. A disc valve system according to claim 1, wherein said intermediate seal member comprises a top face, a bottom face and an outer surface therebetween, said top face being in contact with said rotating disc and providing for said disc to rotate with respect thereto.

53. A disc valve system according to claim 52, wherein said intermediate seal member comprises a ring member.

54. A disc valve system according to claim 52, wherein said outer surface comprises said stationary seal.

55. A disc valve system according to claim 54, wherein said stationary seal comprises a ring seal.

56. A disc valve system according to claim 54, wherein said stationary seal seals the internal periphery of the engine cylinder about an opening thereof leading to the combustion chamber.

57. A disc valve system according to claim 54, wherein said stationary seal extends beyond said seal member outer surface.

58. A disc valve system according to claim 54, wherein said stationary seal is slidably mounted on said outer surface.

59. A disc valve system according to claim 54, wherein said outer surface comprises a groove to hold said stationary seal.

60. A disc valve system according to claim 59, wherein said groove slidably holds said stationary seal.

61. A disc valve system according to claim 52, wherein said bottom face comprises at least one locking element to be mated with a complementary locking element of the engine cylinder.

62. A disc valve system according to claim 61, wherein at least one said bottom face locking element comprises a recess and said complementary engine cylinder locking element comprises a pin.

63. A disc valve system according to claim 62, wherein said recess is generally vertical with respect to said bottom face.

64. A disc valve system according to claim 62, wherein said recess is generally slanted with respect to said bottom face.

65. A disc valve system according to claim 61, wherein said bottom face securely sits on said inner top peripheral region within the engine cylinder.

66. A disc valve system according to claim 52, wherein said bottom face comprises a configuration that is complementary to an inner top peripheral region of said cylinder.

67. A disc valve system according to claim 1, further comprising a disc-rotator assembly for causing the rotational movement of said rotating disc.

68. A disc valve system according to claim 67, wherein said disc-rotator assembly comprises a transmission assembly, the piston-driven engine comprising a crankshaft mounted to the piston, said transmission assembly being configured to be put in operative communication with the crankshaft and with said rotating disc such that said disc rotates in relation to the revolution of the crankshaft thereby providing for said disc to sequentially open and close each said exhaust and intake ports synergistically with the revolution of the crankshaft.

69. A disc valve system according to claim 68, wherein said transmission assembly comprises a gear assembly, said disc comprising gear elements in operative communication with said gear assembly.

70. A disc valve system according to claim 69, wherein said gear elements comprise bevel teeth.

71. A disc valve system according to claim 69, wherein said gear assembly comprises a first gear m operative communication with said crankshaft, said first gear being in operative communication with a second gear, said second gear being in operative communication with said disc gear elements so as to transmit the movement of the crankshaft to said disc.

72. A disc valve system according to claim 71, wherein said first gear is mounted to said crankshaft.

73. A disc valve system according to claim 72, wherein said first and second gears comprise first and second sprocket gears respectively, said movement-transfer assembly comprises a chain member mounted at one end to said first sprocket gear and at an opposite end to said second sprocket gear.

74. A disc valve system according to claim 73, further comprising a tension-assembly being in contact with said chain member as to apply tension thereto thereby interruptingly retarding the rotating movement of said disc at given intervals thereof.

75. A disc valve system according to claim 74, wherein said chain member defines two opposite chain sides between said first and second sprocket gears, said tension-assembly comprising tension elements mounted on said opposite chain sides.

76. A disc valve system according to claim 75, wherein said tension-assembly further comprises a dynamic member mounted to said tension elements.

77. A disc valve system according to claim 76, wherein said dynamic member is made of resilient material.

78. A disc valve system according to claim 76, wherein said tension-assembly comprises first and second opposite tension elements being mounted to a respective chain side, said dynamic member comprising an elongate member having said first and second tension elements mounted at each longitudinal end thereof.

79. A disc valve system according to claim 78, wherein said first and second tension elements are mounted to biasing members for being biased towards a respective said chain side.

80. A disc valve system according to claim 79, wherein said biasing members comprise tension springs.

81. A disc valve system according to claim 78, wherein said first and second tension elements are so positioned and wherein said dynamic member is so configured as to collectively and reciprocally move side-to-side when said chain member acts on at least one of said first and second tension elements.

82. A disc valve system according to claim 81, wherein said reciprocal movement provides for applying interrupted pressure on a each of said chain sides at a time and at substantially regular intervals during the rotating movement of said disc.

83. A disc valve system according to claim 78, wherein said tension elements are mounted on the outer face of said chain sides, said dynamic member comprising openings near said each longitudinal ends receiving said chain sides therethrough without interfering therewith.

84. A disc valve system according to claim 78, wherein said dynamic member comprises a generally elliptical shape defining an elliptical opening providing a free working space for said chain member.

85. A disc valve system according to claim 73, wherein said second sprocket gear is in operative communication with a disc-gear, said disc gear being in operative communication with said disc gear elements.

86. A disc valve system according to claim 85, wherein said second sprocket gear comprises an aperture for receiving an extending portion from said disc gear.

87. A disc valve system according to claim 86, wherein said second sprocket gear comprises a resilient member interposed between said second sprocket gear and said extending portion.

88. A disc valve system according to claim 87, wherein said second sprocket gear comprises a hub for holding said resilient member.

89. A disc valve system according to claim 88, wherein said resilient member defines an aperture for receiving said extending portion.

90. A disc valve system according to claim 88, wherein said resilient member comprises a synthetic rubber material.

91. A disc valve system according to claim 90, wherein said movement-transfer assembly comprises a plurality of communicating gears.

92. A disc valve system according to claim 85, wherein said disc-gear comprises a pinion gear and said disc gear elements comprise bevel teeth.

93. A disc valve system according to claim 73, wherein said at least one of said first and second sprocket gears comprises a resilient member.

94. A disc valve system according to claim 93, wherein said resilient member of said first sprocket gear is interposed therebetween and said crankshaft.

95. A disc valve system according to claim 93, wherein said resilient member of said second sprocket gear is interposed therebetween and a disc-gear in communication with said disc-gear elements.

96. A disc valve system according to claim 71, wherein said gear assembly further comprises a movement-transfer assembly in operative communication with both said first and second gears for transmitting the movement of said first gear to said second gear.

97. A disc valve system according to claim 96, wherein said movement transfer assembly comprises an elongate member being rotatable about its longitudinal axis, said elongate member comprising first and second elongate member gears at the longitudinal ends thereof, said first and second elongate member gears being in operative communication with said first and second gears respectively.

98. A disc valve system according to claim 97, wherein said first and second elongate member gears first and second pinion gears respectively, said first and second gears comprising respective bevel teeth, said first and second gear bevel teeth being meshed with said first and second pinion gears respectively.

99. A disc valve system according to claim 98, wherein said disc pinion gear is mounted to said second gear.

100. A disc valve system according to claim 97, wherein said second gear is in operative communication with a disc gear, said disc gear being in operative communication with said disc gear elements.

101. A disc valve system according to claim 100, wherein said disc gear comprises a disc pinion gear and said disc gear elements comprise gear teeth.

102. A piston driven internal combustion engine comprising:

at least one cylinder head manifold comprising exhaust and intake ports;

at least one engine cylinder housing a piston and defining a combustion chamber, at least one rotating disc mounted between said cylinder head manifold and said engine cylinder, said rotating disc comprising sequencing ports so configured as to be brought into periodic communication with said exhaust and intake ports at cyclic intervals of the rotating movement of said rotating disc thereby providing for said exhaust and intake ports to be brought into periodic communication with said combustion chamber; and an intermediate seal member mounted within said said engine cylinder at a junction of said rotating disc and said engine cylinder so as to seal said combustion chamber, said intermediate seal member comprising a dynamic seal for contact with said rotating disc and a stationary seal for sealing contact with said engine cylinder;

whereby the rotating movement of said rotating disc sequentially opens and closes each said exhaust and intake ports synergistically with the translational movement of said piston.

* * * * *